US011143998B2

(12) United States Patent
Kojima et al.

(10) Patent No.: US 11,143,998 B2
(45) Date of Patent: Oct. 12, 2021

(54) IMAGE FORMING APPARATUS HAVING PEEL-OFF UNITS

(71) Applicant: FUJIFILM Business Innovation Corp., Tokyo (JP)

(72) Inventors: Noriaki Kojima, Kanagawa (JP); Yuichi Omori, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 168 days.

(21) Appl. No.: 16/294,943

(22) Filed: Mar. 7, 2019

(65) Prior Publication Data

US 2020/0019107 A1 Jan. 16, 2020

(30) Foreign Application Priority Data

Jul. 13, 2018 (JP) ..... JP2018-133352

(51) Int. Cl.
*G03G 15/00* (2006.01)

(52) U.S. Cl.
CPC ..... *G03G 15/6529* (2013.01)

(58) Field of Classification Search
CPC ..... G03G 15/6529
See application file for complete search history.

(56) References Cited

U.S. PATENT DOCUMENTS

2011/0188905 A1* 8/2011 Shinkawa ..... G03G 15/20 399/323
2016/0033905 A1* 2/2016 Lefevre ..... G03G 15/6532 399/316

FOREIGN PATENT DOCUMENTS

JP 06222681 A * 8/1994
JP 2008158137 7/2008

OTHER PUBLICATIONS

JP_06222681_Machine Translation, Nagame et al., Japan, 1994.*

* cited by examiner

*Primary Examiner* — Victor Verbitsky
(74) *Attorney, Agent, or Firm* — JCIPRNET

(57) ABSTRACT

An image forming apparatus includes an image carrier, a first peel-off unit whose end portion is in contact with the image carrier and that peels off a recording medium from the image carrier, and a second peel-off unit whose end portion is not in contact with the image carrier and that peels off a recording medium from the image carrier. The second peel-off unit is disposed in such a way that the end portion thereof is located at a position that is the same as or upstream of a position of the end portion of the first peel-off unit in a rotation direction of the image carrier, and the second peel-off unit is movable so that the end portion thereof moves away from the image carrier.

20 Claims, 20 Drawing Sheets

IMAGE FORMING APPARATUS HAVING PEEL-OFF UNITS

CROSS-REFERENCE TO RELATED APPLICATIONS

This application is based on and claims priority under 35 USC 119 from Japanese Patent Application No. 2018-133352 filed Jul. 13, 2018.

BACKGROUND

(i) Technical Field

The present disclosure relates to an image forming apparatus.

(ii) Related Art

Japanese Unexamined Patent Application Publication No. 2008-158137 (paragraphs 0029 to 0030, FIG. 2) describes an example of an image forming apparatus that can prevent adhesion of a developer (toner) to a recording medium, which may occur when peeling off the recording medium from an image carrier, such as a rotating photoconductor.

The image forming apparatus described in Japanese Unexamined Patent Application Publication No. 2008-158137 includes a peel-off unit for peeling off a recording medium from the surface of a photoconductor drum and guiding the recording medium in the transport direction. The peel-off unit includes a peel-off claw that is in contact with the photoconductor drum, and auxiliary claws that are disposed on both sides of the peel-off claw and that are not in contact with the photoconductor drum. The auxiliary claws guide a recording medium that is peeled off by the peel-off claw so that the recording medium is transported without contacting a back portion of the peel-off claw.

Japanese Unexamined Patent Application Publication No. 2008-158137 also describes that end portions of the auxiliary claws are positioned closer than the back portion of the peel-off claw to the photoconductor drum.

SUMMARY

Aspects of non-limiting embodiments of the present disclosure relate to an image forming apparatus that can suppress smearing of a trailing end of a recording medium, which is being transported, due to adhesion of a developer on an end portion of a first peel-off unit to the trailing end while avoiding jamming of the recording medium in a second peel-off unit, in contrast to a case where an end portion of the second peel-off unit that does not contact an image carrier is disposed downstream, in the rotation direction of the image carrier, of an end portion of the first peel-off unit that contacts the image carrier and the second peel-off unit is disposed so as to be fixed in position relative to the first peel-off unit.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including an image carrier that rotates while carrying an unfixed image to be transferred to a recording medium, a first peel-off unit whose end portion is in contact with the image carrier and that peels off a recording medium from the image carrier, and a second peel-off unit whose end portion is not in contact with the image carrier and that peels off a recording medium from the image carrier. The second peel-off unit is disposed in such a way that the end portion thereof is located at a position that is the same as or upstream of a position of the end portion of the first peel-off unit in a rotation direction of the image carrier, and the second peel-off unit is movable so that the end portion thereof moves away from the image carrier.

BRIEF DESCRIPTION OF THE DRAWINGS

Exemplary embodiments of the present disclosure will be described in detail based on the following figures, wherein.

DETAILED DESCRIPTION

Hereinafter, exemplary embodiment of the present disclosure will be described with reference to the drawings.

First Exemplary Embodiment

Figure 1:
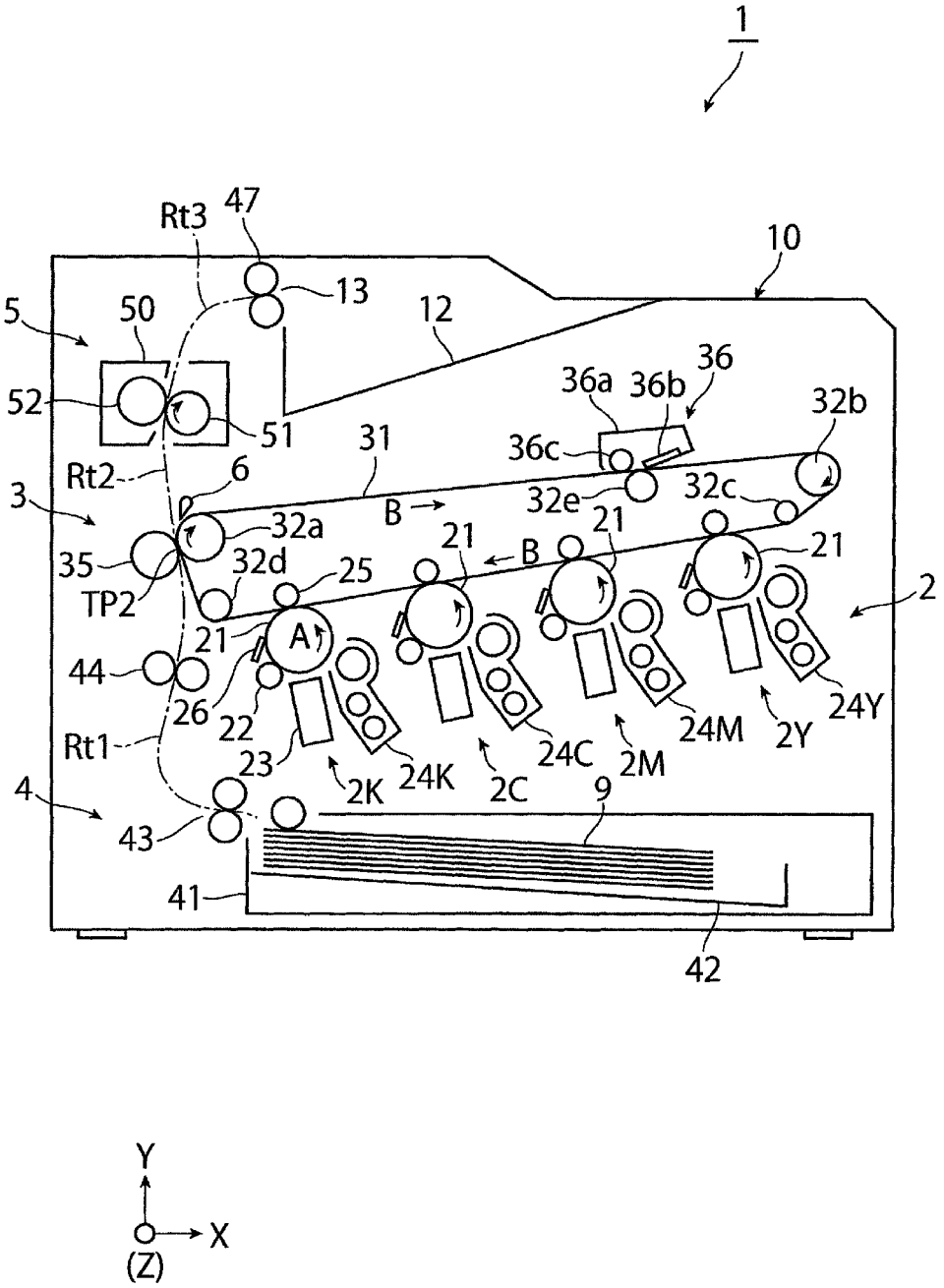
FIG. 1 is a schematic view of the entirety of an image forming apparatus according to a first exemplary embodiment.
Figure 2:
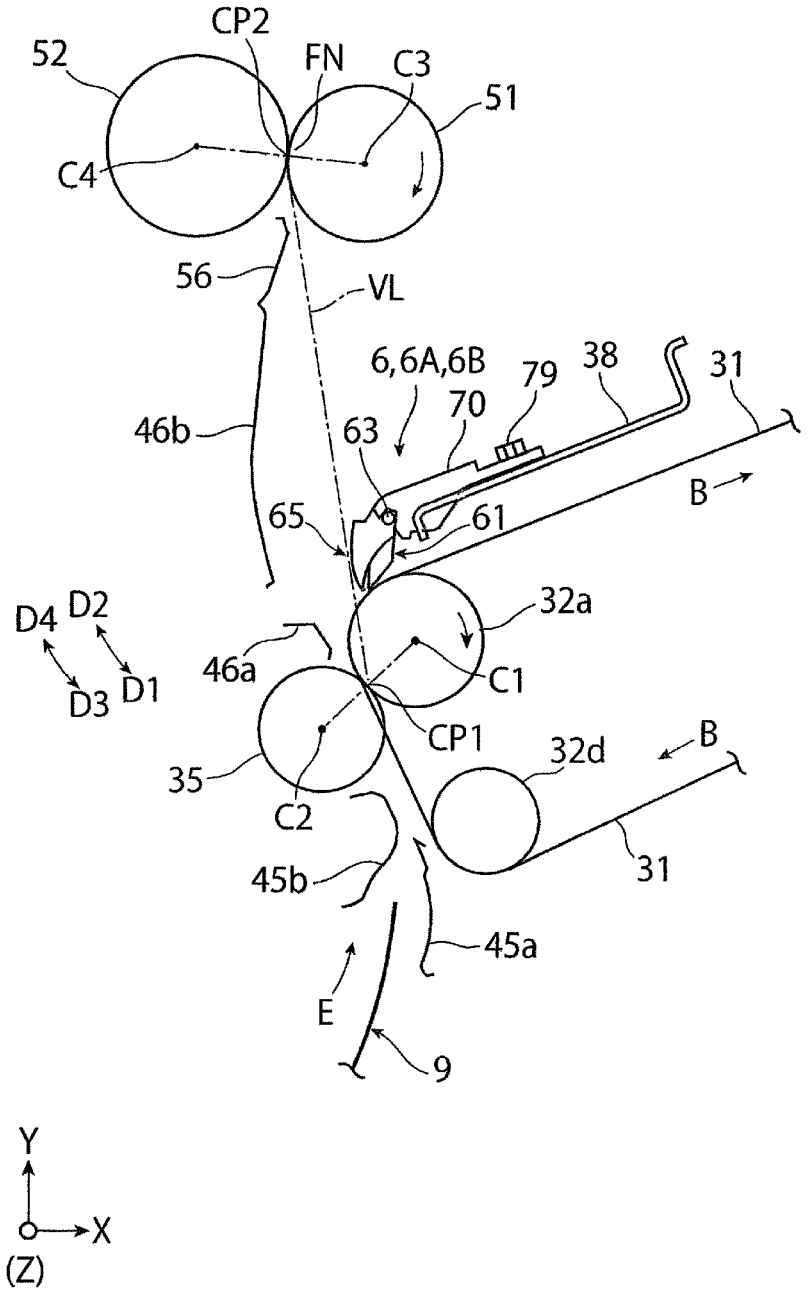
FIG. 2 is a schematic view of a part of the image forming apparatus shown in FIG. 1.

FIGS. 1 and 2 illustrate an example of an image forming apparatus 1 according to a first exemplary embodiment. FIG. 1 illustrates the structure of the entirety of the image forming apparatus 1. FIG. 2 illustrates the structure of a part of the image forming apparatus 1 (a sheet peel-off section at a second-transfer position and a region surrounding the sheet peel-off section).

Arrows X, Y, and Z in each figure respectively indicate the width direction, the height direction, and the depth direction of a three-dimensional space of the figure. A small circle where the arrows X and Y intersect in each of FIGS. 1 and 2 represents that the Z direction is oriented perpendicularly into the plane of the figure.

The image forming apparatus 1 forms an image, which is composed of a developer, on a sheet 9, which is an example of a recording medium. The image forming apparatus 1 according to the first exemplary embodiment is, for example, a printer that forms an image corresponding to image information obtained from an external device such as an information terminal.

As illustrated in FIG. 1, the image forming apparatus 1 includes, in an inner space in a housing 10: an image forming section 2 that forms an unfixed image, which is composed of a developer, based on the image information; an intermediate transfer section 3 that temporarily carries the unfixed image formed by the image forming section 2 and second-transfers the unfixed image to a sheet 9; a sheet feeding section 4 that accommodates the sheet 9 and supplies the sheet 9 to a second-transfer position in the intermediate transfer section 3; a fixing section 5 that fixes the unfixed image, which has been second-transferred by the intermediate transfer section 3, to the sheet 9; a sheet peel-off section 6 that peels off the sheet 9, which has been second-transferred by the intermediate transfer section 3; and other components.

The image information is, for example, information related to characters, figures, photographs, patterns, and the like. An alternate-long-and-short-dash line in FIG. 1 and other figures represents a transport path along which the sheet 9 is transported in the housing 10. The housing 10 is a structure that includes various support members and outer members and has an appropriate shape. The housing 10 has, in a part of a top plate thereof, a sheet output tray 12 on which sheets 9, having images formed thereon, are stacked; and a sheet output hole 13, through which the sheets 9 are discharged toward the sheet output tray 12.

The image forming section 2 forms a toner image that is an unfixed image composed of a toner as a developer. In the first exemplary embodiment, the image forming section 2 includes four image forming sections 2Y, 2M, 2C, and 2K, which are respectively dedicated to form toner images in four colors: yellow (Y), magenta (M), cyan (C), and black (K).

The four image forming sections 2 (Y, M, C, and K) each include a photoconductor drum 21, which is a photoconductor that rotates in the direction indicated by an arrow A; and a charging device 22, an exposure device 23, a developing device 24 (Y, M, C, or K), a first-transfer device 25, a drum cleaner 26, and other devices, which are disposed around the photoconductor drum 21. In FIG. 1, the numerals 21 to 26 are attached only the image forming section 2K for black (K), and some of these numerals are attached to the image forming sections 2 (Y, M, and C) for the other colors.

The charging device 22 charges an outer peripheral surface (image forming surface) of the photoconductor drum 21. The exposure device 23 forms an electrostatic latent image in a predetermined color (Y, M, C, or K) on the outer peripheral surface of the photoconductor drum 21 by exposing the outer peripheral surface to light based on image information. The developing device 24 (Y, M, C, or K) forms a visible image by developing the electrostatic latent image, which has been formed on the outer peripheral surface of the photoconductor drum 21, by using a toner in a predetermined color (Y, M, C, or K). The first-transfer device 25 transfers toner images in different colors to the intermediate transfer section 3 (an intermediate transfer belt 31). The drum cleaner 26 cleans the photoconductor drum 21 by removing unwanted substances, such as toner and paper dust, that adhere to the outer peripheral surface of the photoconductor drum 21.

In each of the image forming sections 2 (Y, M, C, and K), a position where the photoconductor drum 21 and the first-transfer device 25 face each other is a first-transfer position where the image forming section 2 performs first-transfer of a toner image.

The intermediate transfer section 3 allows toner images in different colors, which have been formed by the image forming sections 2 (Y, M, C, and K), to be first-transferred thereto, holds and transports the toner images, and lastly, second-transfers the toner images to the sheet 9. In the first exemplary embodiment, the intermediate transfer section 3 is disposed above the image forming sections 2 (Y, M, C, and K) in the housing 10. To be specific, the intermediate transfer section 3 includes the intermediate transfer belt 31, which allows unfixed toner images to be transferred thereto from the photoconductor drums 21 of the image forming sections 2 (Y, M, C, and K) and that carries the unfixed toner images; and other devices described below, which are disposed around the intermediate transfer belt 31. The intermediate transfer belt 31 is an example of an image carrier or an image carrier belt.

A plurality of support rollers 32*a* to 32*e* are disposed inside of the intermediate transfer belt 31. The intermediate transfer belt 31 is supported by the plurality of support rollers 32*a* to 32*e* so as to successively pass the first-transfer positions in the image forming sections 2 (Y, M, C, and K) and rotate (cyclically move) in the direction indicated by an arrow B. The support roller 32*a* functions as a driving roller and a second-transfer backup roller. The support roller 32*b* functions as a tension roller. The support roller 32*e* functions as a cleaning backup roller of a belt cleaning device 36 described below.

The first-transfer devices 25 of the image forming sections 2 (Y, M, C, and K) are disposed inside of the intermediate transfer belt 31. The first-transfer device 25, which is a part of the intermediate transfer section 3, presses the intermediate transfer belt 31 against the photoconductor drum 21 by using a first-transfer member, to which a first-transfer current is supplied and that has a roller-like shape.

A second-transfer device 35 is disposed on a part of the outer peripheral surface of the intermediate transfer belt 31 that is supported by the support roller 32*a*. The second-transfer device 35 allows the sheet 9 to pass and second-transfers the toner images on the intermediate transfer belt 31 to the sheet 9. The second-transfer device 35 includes a second-transfer member to which a second-transfer current is supplied and that has a roller-like shape. The second-transfer device 35 allows the sheet 9 to pass by pressing, with the second-transfer member, the sheet 9 against a part of the outer peripheral surface of the intermediate transfer belt 31 that is supported by the support roller 32*a*. In the intermediate transfer section 3, the position where the second-transfer device 35 is in contact with the outer peripheral surface of the intermediate transfer belt 31 is a second-transfer position TP2 where the intermediate transfer section 3 performs second-transfer of the toner images.

The belt cleaning device 36 is disposed outside and around the intermediate transfer belt 31. The belt cleaning device 36 cleans the intermediate transfer belt 31 by removing unwanted substances, such as toner, that remain on the outer peripheral surface of the intermediate transfer belt 31 after second-transfer. The belt cleaning device 36 includes, inside a housing 36*a*, a plate-shaped cleaning member 36*b*, which is pressed against the outer peripheral surface of the intermediate transfer belt 31; a recovery member 37, which rotates and recovers unwanted substances removed by the cleaning member 36*b*; and the like.

The sheet peel-off section 6 peels off the sheet 9, after second-transfer in the intermediate transfer section 3, from the intermediate transfer belt 31. Details of the sheet peel-off section 6 will be described below.

The sheet feeding section 4 accommodates the sheet 9 and supplies the sheet 9 to the second-transfer position TP2 of the intermediate transfer section 3. In the first exemplary embodiment, the sheet feeding section 4 is disposed below the image forming sections 2 (Y, M, C, and K) in the housing 10. To be specific, the sheet feeding section 4 includes a sheet container 41, a feeding device 43, and other components.

The sheet container 41 includes a tray 42 that holds a stack of a plurality of sheets 9 in a predetermined orientation. The sheet container 41 is removably attached to the housing 10. The feeding device 43 feeds the sheets 9, which are stacked on the tray 42 of the sheet container 41, one by one from the top of the stack by using a plurality of rollers and other components.

The fixing section 5 fixes toner images, which have been second-transferred by the intermediate transfer section 3, to the sheet 9. In the first exemplary embodiment, the fixing section 5 is disposed in the housing 10 at a position above the second-transfer position TP2 of the intermediate transfer section 3. To be specific, the fixing section 5 includes a housing 50 having an inlet and an outlet for the sheet 9; and a heating rotational body 51, a pressing rotational body 52, and other components, which are disposed in an inner space of the housing 50.

The heating rotational body 51 is a part of a fixing section that rotates in the direction indicated by an arrow and that has a roller-like shape or the like. The heating rotational body 51 is heated by a heater (not shown) to keep an appropriate temperature. The pressing rotational body 52 is a part of the fixing section that is rotated by being in contact with the heating rotational body 51 with an appropriate pressure and that has a roller-like shape or the like.

A part of the fixing section 5 where the heating rotational body 51 and the pressing rotational body 52 are in contact with each other is a nip FN (fixing-processing portion) where the fixing section 5 heats and presses the sheet 9, to which unfixed toner images have been transferred, to fix the toner images to the sheet 9.

In the image forming apparatus 1, as illustrated in FIG. 1, a sheet transport path Rt1, along which the sheet 9 is supplied from the sheet feeding section 4 to the second-transfer position TP2, is formed between the sheet feeding section 4 and the second-transfer position TP2 of the intermediate transfer section 3. As illustrated in FIGS. 1 and 2, in the sheet transport path Rt1, a pair of transport rollers 44, which nip the sheet 9 therebetween and transport the sheet 9; a plurality of guide members 45*a* and 45*b*, which form a transport space for the sheet 9 and guide transportation of the sheet 9; and the like are disposed. The pair of transport rollers 44 function as so-called registration rollers, which correct diagonal movement of the sheet 9 and which feeds the sheet 9 at an appropriate timing.

In the image forming apparatus 1, as illustrated in FIG. 1, a guiding transport path Rt2, which guides the sheet 9 after second-transfer to the nip FN, is disposed between the second-transfer position TP2 of the intermediate transfer section 3 and the nip FN of the fixing section 5. As illustrated in FIG. 2, in the guiding transport path Rt2, a plurality of guide members 46*a*, 46*b*, and 56, which form a transport space for the sheet 9 and guide transportation of the sheet 9, are disposed. The guide member 56 is an inlet guide member that is disposed at an inlet of the housing 50 of the fixing section 5.

Here, an alternate-long-and-short-dash line VL, which is shown in FIG. 2 and other figures, represents an ideal transport path for the sheet 9 in the guiding transport path Rt2. The alternate-long-and-short-dash line VL is an imaginary line connecting an intersecting point CP1 and an intersecting point CP2, where CP1 is the intersecting point where the nip at the second-transfer position TP2 intersects a straight line that connects the rotation center C1 of the support roller 32*a* of the intermediate transfer belt 31 and the rotation center C2 of the roll-shaped second-transfer member of the second-transfer device 35, and CP2 is the intersection point where the nip FN intersects a straight line that connects the rotation center C3 of the heating rotational body 51 of the fixing section 5 and the rotation center C4 of the pressing rotational body 52.

In the image forming apparatus 1, as illustrated in FIG. 1, an output transport path Rt3, along which the sheet 9, after fixing has been finished, is transported to the sheet output hole 13 and is discharged to the sheet output tray 12, is disposed between the fixing section 5 and the sheet output hole 13. In the output transport path Rt3, a pair of output rollers 47, which are disposed in front of the sheet output hole 13, and a guide member (not shown), which forms a transport space of the sheet 9 and guides transportation of the sheet 9, are disposed.

The image forming apparatus 1 performs an image forming operation as follows.

First, a controller (not shown) of the image forming apparatus 1 receives a request for forming an image from an external device or the like. Then, appropriate parts of the image forming section 2, the intermediate transfer section 3, the sheet feeding section 4, the fixing section 5, and the like are activated at predetermined timings. Here, an operation for forming a so-called full color image, which is a color image that is composed toner images of four colors (Y, M, C, and K) that are formed by activating all of the image forming sections 2 (Y, M, C, and K), will be described as an example.

As illustrated in FIG. 1, in each of the image forming sections 2 (Y, M, C, and K), the photoconductor drum 21 starts rotating in a direction indicated by the arrow A, the charging device 22 charges the outer peripheral surface of the photoconductor drum 21 to an appropriate potential, and the exposure device 23 irradiates outer peripheral surface of the charged photoconductor drum 21 with light corresponding to a processed image signal. Thus, each of the image forming sections 2 (Y, M, C, and K) forms an electrostatic latent image for a corresponding one of the four colors.

Then, each of the developing devices 24 (Y, M, C, and K) develops the electrostatic latent image by supplying toner of a corresponding color (one of Y, M, C, and K) and by attaching the toner to the latent image by using static electricity. Thus, a toner image corresponding to electrostatic latent image is formed on the outer peripheral surface of the photoconductor drum 21.

In each of the image forming sections 2 (Y, M, C, and K), the drum cleaner 26 cleans the outer peripheral surface of the photoconductor drum 21 over a period including a period after first-transfer.

Next, in the intermediate transfer section 3, when the intermediate transfer belt 31 rotates in the direction indicated by the arrow B and passes the first-transfer positions of the image forming sections 2 (Y, M, C, and K), the first-transfer devices 25 successively transfer the color toner images on the outer peripheral surfaces of the photoconductor drums 21 of the image forming sections 2 (Y, M, C, and K) to the outer peripheral surface of the intermediate transfer belt 31. As the intermediate transfer belt 31 rotates, the toner images, which have been first-transferred to the outer peripheral surface of the intermediate transfer belt 31, are transported toward the second-transfer position TP2.

In the sheet feeding section 4, the feeding device 43 supplies the sheet 9, which is contained in the sheet container 41, toward the second-transfer position TP2 of the intermediate transfer section 3 so as to be in time with a second-transfer operation in the intermediate transfer section 3.

At this time, the sheet 9, which is fed by the feeding device 43 from the sheet container 41 of the sheet feeding section 4, is transported through the sheet transport path Rt1 to the transport rollers 44, which are registration rollers. Then, the transport rollers 44 feed the sheet 9 to the second-transfer position TP2 at an appropriate timing.

Next, in the intermediate transfer section 3, the second-transfer device 35 second-transfers the toner images, which have been first-transferred to and carried on the outer peripheral surface of the intermediate transfer belt 31, simultaneously to the sheet 9 supplied to the second-transfer position TP2.

In the intermediate transfer section 3, the belt cleaning device 36 cleans the outer peripheral surface of the intermediate transfer belt 31 over a period including a period after second-transfer.

Next, the sheet 9, to which the toner images have been second-transferred in the intermediate transfer section 3, is fed from the second-transfer position TP2 to the fixing section 5 through the guiding transport path Rt2.

At this time, the sheet peel-off section 6 separates and peels off the sheet 9, which has passed the second-transfer position TP2 and has not been sufficiently or completely peeled off from the intermediate transfer belt 31, from the outer peripheral surface of the intermediate transfer belt 31.

In the fixing section 5, the sheet 9, which has the toner images thereon, enters and passes through the nip FN where the heating rotational body 51 and the pressing rotational body 52 are in pressed-contact with each other. Thus, the toner images on the sheet 9 are heated under pressure and melted in the nip FN, and are fixed to the sheet 9.

Lastly, the sheet 9, on which the toner image have been fixed, is discharged from the fixing section 5, transported through the output transport path Rt3, and placed on the sheet output tray 12.

At this time, the sheet 9, which has been discharged from the fixing section 5, is fed through the output transport path Rt2 to an output roller 46. Subsequently, the sheet 9 is fed to the outside of the housing 10 by the output roller 46 through the sheet output hole 13. Thus, the sheet 9 after fixing is discharged onto the sheet output tray 12.

Through the series of operations described above, a full-color image is formed on one surface of the sheet 9, and the image forming operation is finished.

The image forming apparatus 1 is capable of forming a monochrome image by performing an image forming operation by activating one of the image forming sections 2 (Y, M, C, and K). The image forming apparatus 1 is also capable of forming a color image that is not a full-color image by performing an image forming operation by activating two or three of the image forming sections 2 (Y, M, C, and K).

Failures in Sheet Peel-Off Section

If the image forming apparatus 1 does not have the sheet peel-off section 6, the following failures occur.

For example, the following failures occur, if an image forming operation is performed by using a thin sheet 9U that is not recommended in the user's manual or the like of the image forming apparatus 1.

Figure 18:
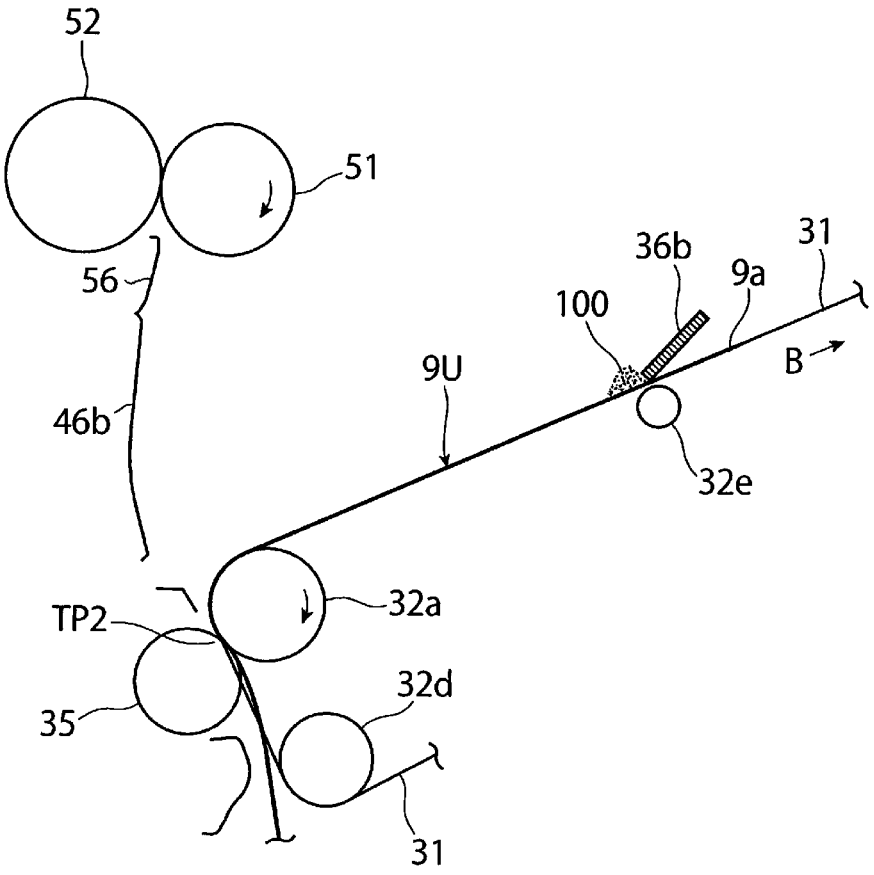
FIG. 18 is a schematic view illustrating an example of a failure that occurs if a sheet peel-off section is not provided.

In this case, as illustrated in FIG. 18, the thin sheet 9U is not peeled off from the intermediate transfer belt 31 after second-transfer, and is transported while adhering to the intermediate transfer belt 31. Finally, a front portion of the sheet 9U, including a leading end 9*a*, may enter the belt cleaning device 36, which is located at a position downstream of the second-transfer position TP2 in the rotation direction B of the intermediate transfer belt 31. Then, the sheet 9U is pressed by the plate-shaped cleaning member 36*b* against the intermediate transfer belt 31 and jammed in the belt cleaning device 36.

Accordingly, in this case, for example, the following failures occur: it is difficult to pull out and remove the sheet 9U from the belt cleaning device 36; unwanted substances 100, such as toner removed and collected by the belt cleaning device 36, adhere to the sheet 9U and smear the sheet 9U, when pulling out the sheet 9U; and the adhering toner is scattered and smear the inside of the image forming apparatus 1, when the sheet 9U is pulled out of the belt cleaning device 36.

Even when the image forming apparatus 1 includes the sheet peel-off section 6, another failure may occur as described below.

Figure 19A:
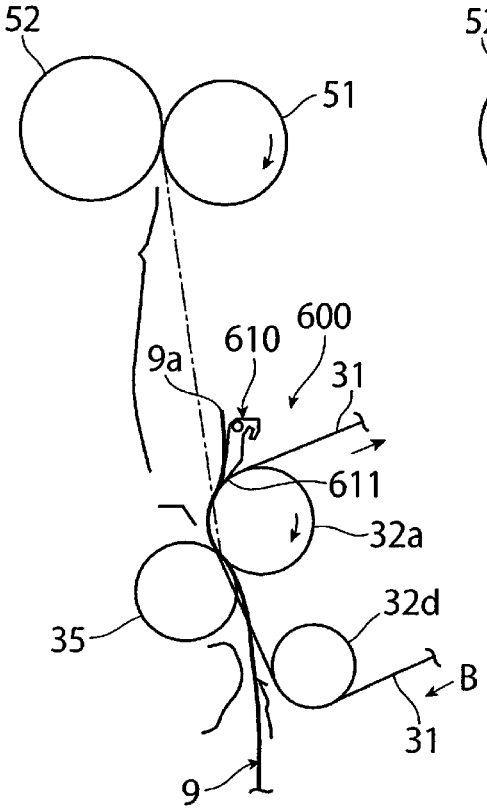
FIG. 19A is a schematic view illustrating a sheet peeling-off function of an existing sheet peel-off section, and FIG. 19B schematic view illustrating an exemplary state in which smearing of a trailing end of a sheet occurs in the sheet peel-off unit shown in FIG. 19A.
Figure 19B:
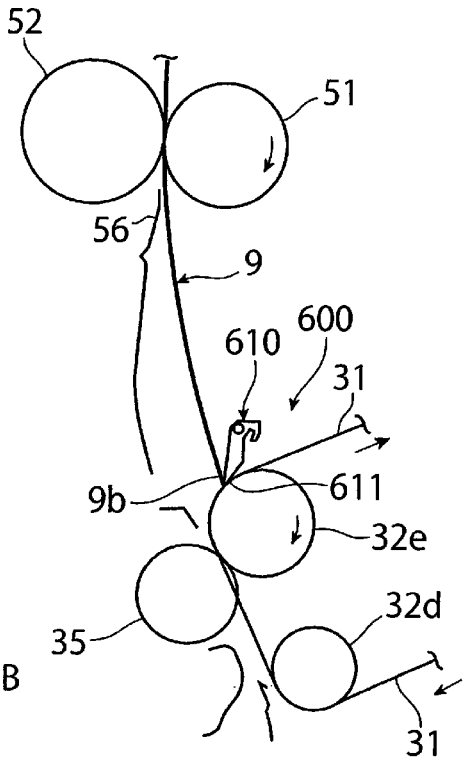

FIGS. 19A and 19B illustrate a case where a sheet peel-off section 600 is used as the sheet peel-off section 6. The sheet peel-off section 600 has only a contact-peel-off claw 610 whose end portion 611 is tapered and that is in contact with the outer peripheral surface of the intermediate transfer belt 31. In this case, the following occurs.

First, with the sheet peel-off section 600, even if an image forming operation is performed by using the thin sheet 9U as the sheet 9, after second-transfer, the contact-peel-off claw 610 peels off the thin sheet 9U from the intermediate transfer belt 31 or blocks passage of the thin sheet 9U. Therefore, a front portion of the thin sheet 9U is prevented from entering the belt cleaning device 36 as described above.

However, in this case, the end portion 611 of the contact-peel-off claw 610 of the sheet peel-off section 600 may be smeared due to adhesion of transfer residual toner that remains on the intermediate transfer belt 31.

Therefore, when the sheet 9 after second-transfer passes the second-transfer position TP2, if a trailing end 9*b* of the sheet 9 contacts the end portion 611 of the peel-off claw 610, a failure occurs in that transfer residual toner, which is present at the end portion 611 of the peel-off claw 610, adheres to and smear the trailing end 9*b*.

Figure 20:
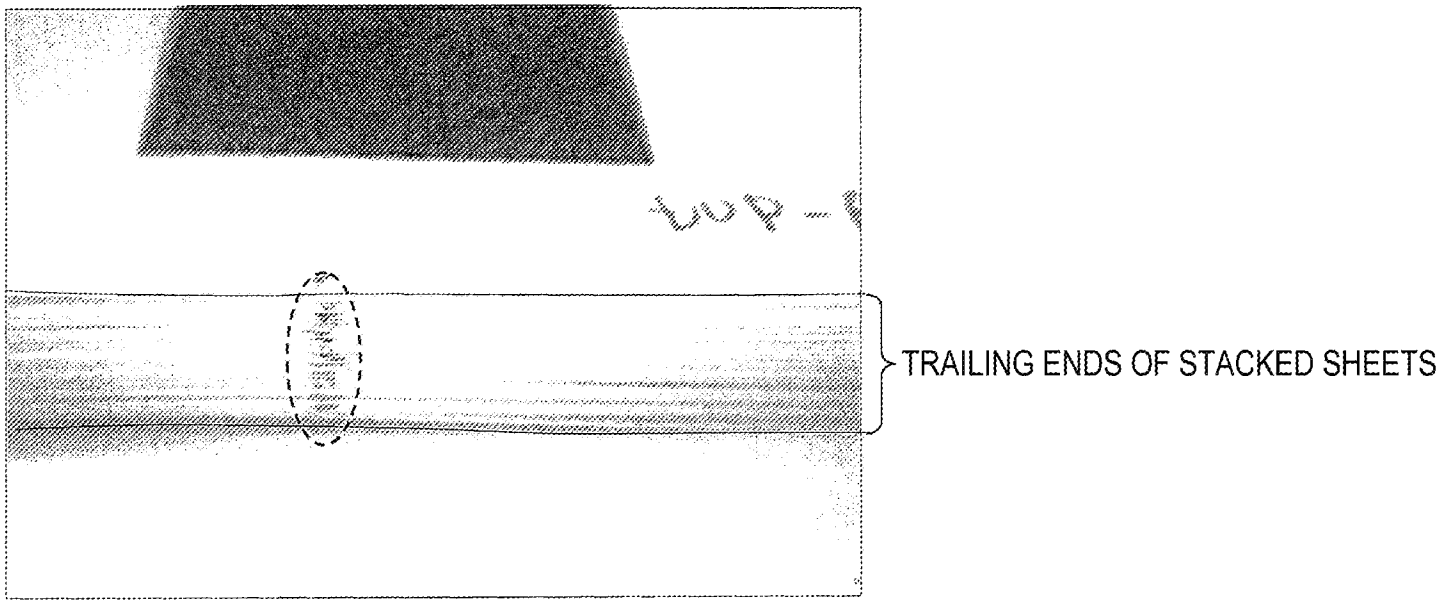
FIG. 20 illustrates an example of a state in which smear on trailing ends of sheets is conspicuous.

If the trailing end 9*b* of the sheet 9 is smeared with toner in this way, the smear becomes conspicuous when a plurality of the sheets 9 are stacked after the image forming operation, as shown in a region surrounded by the dotted line in FIG. 20.

Detailed Structure of Sheet Peel-Off Section

Therefore, in the image forming apparatus 1, the sheet peel-off section 6, which is structured as described below, is disposed in the intermediate transfer section 3 at a position on the intermediate transfer belt 31 downstream of the second-transfer position TP2.

As illustrated in FIGS. 2 to 9 and other figures, the sheet peel-off section 6 includes a first peel-off unit 61 and a second peel-off unit 65. The first peel-off unit 61 has an end portion 62 that is in contact with the outer peripheral surface of the intermediate transfer belt 31 and peels off the sheet 9 after second-transfer from the intermediate transfer belt 31. The second peel-off unit 65 has an end portion 66 that is not in contact with the outer peripheral surface of the intermediate transfer belt 31 and peels off the sheet 9 after second-transfer from the intermediate transfer belt 31.

Figure 7:
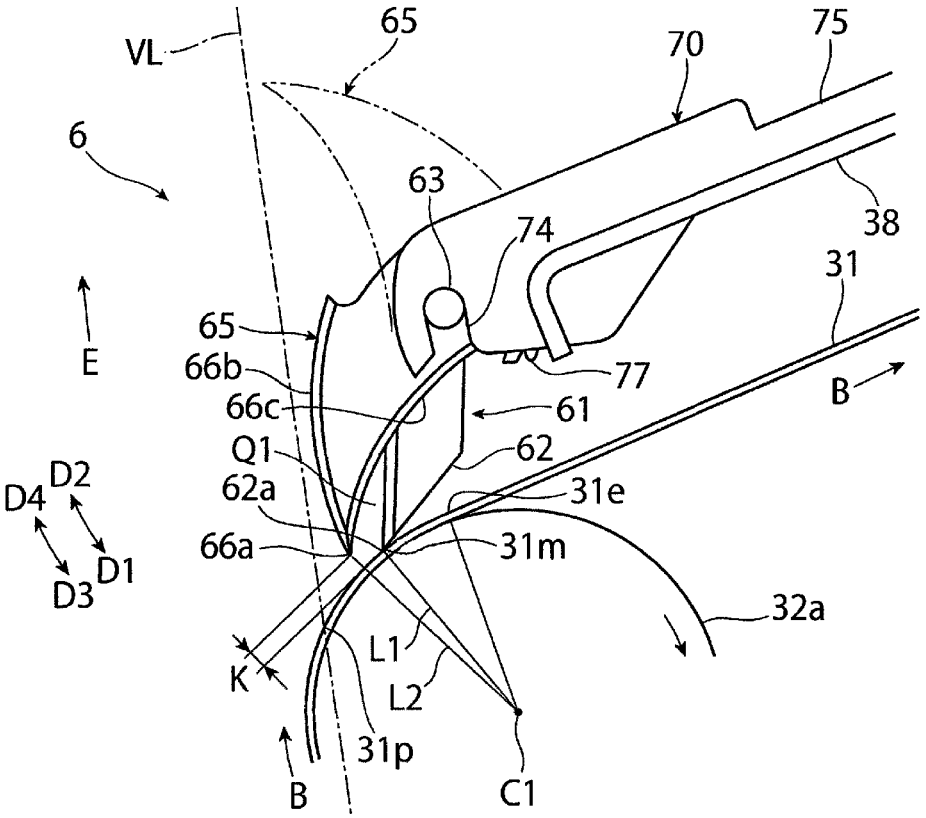
FIG. 7 is a schematic view of the sheet peel-off section and a region surrounding the sheet peel-off section, as seen from one side.
Figure 9:
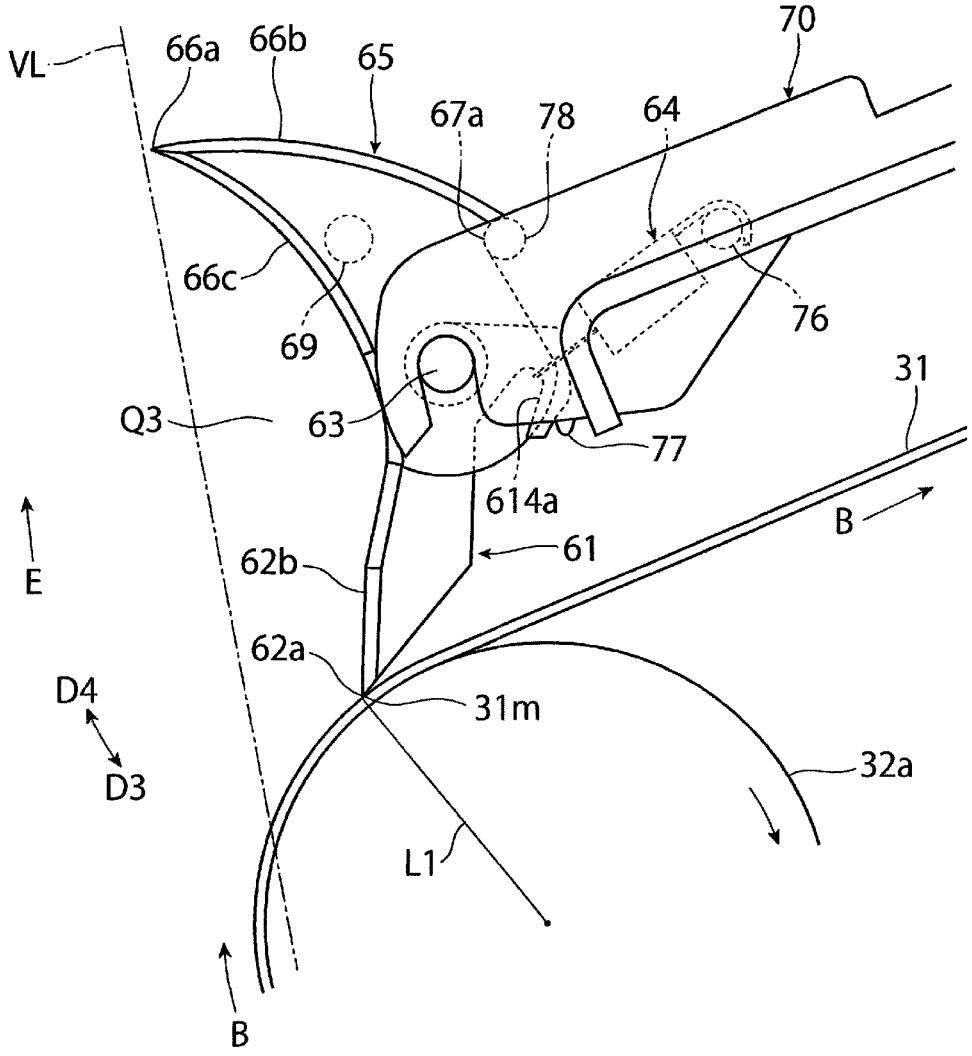
FIG. 9 is a schematic view illustrating the structure of the sheet peel-off section when the second peel-off unit has swung.

Moreover, as illustrated in FIGS. 7 and 9 and other figures, in the sheet peel-off section 6, the second peel-off unit 65 is disposed in such a way that (a tip 66*a* of) the end portion 66 is located at a position upstream of (a tip 62*a* of) the end portion 62 of the first peel-off unit 61 in the rotation direction B of the intermediate transfer belt 31; and the second peel-off unit 65 is movable so that the end portion 62 moves away from the intermediate transfer belt 31.

Here, phrase "the second peel-off unit 65 is movable so that the end portion 66 of the second peel-off unit 65 moves away from the intermediate transfer belt 31" can be paraphrased as "the second peel-off unit 65 is moved by being pushed by the sheet 9 that is peeled off by the first peel-off unit 61". The term "movable" can be paraphrased, as illustrated in FIG. 7, as "the second peel-off unit 65 is moved so as to expand a space Q1 between the second peel-off unit 65 and the first peel-off unit 61 by being pushed by the sheet 9 that is peeled off by the first peel-off unit 61".

As illustrated in FIGS. 3 to 5B and other figures, in the sheet peel-off section 6 according to the first exemplary embodiment, the second peel-off unit 65 includes a pair of left and right second peel-off units 65A and 65B, which are disposed on both sides of the first peel-off unit 61 in the width direction J of the intermediate transfer belt 31 (the rotation-axis direction of the support roller 32*a*).

The pair of left and right second peel-off units 65A and 65B have the same structure. Therefore, the following descriptions of the second peel-off unit 65 apply to the pair of second peel-off units 65A and 65B, unless otherwise noted.

Figure 3:
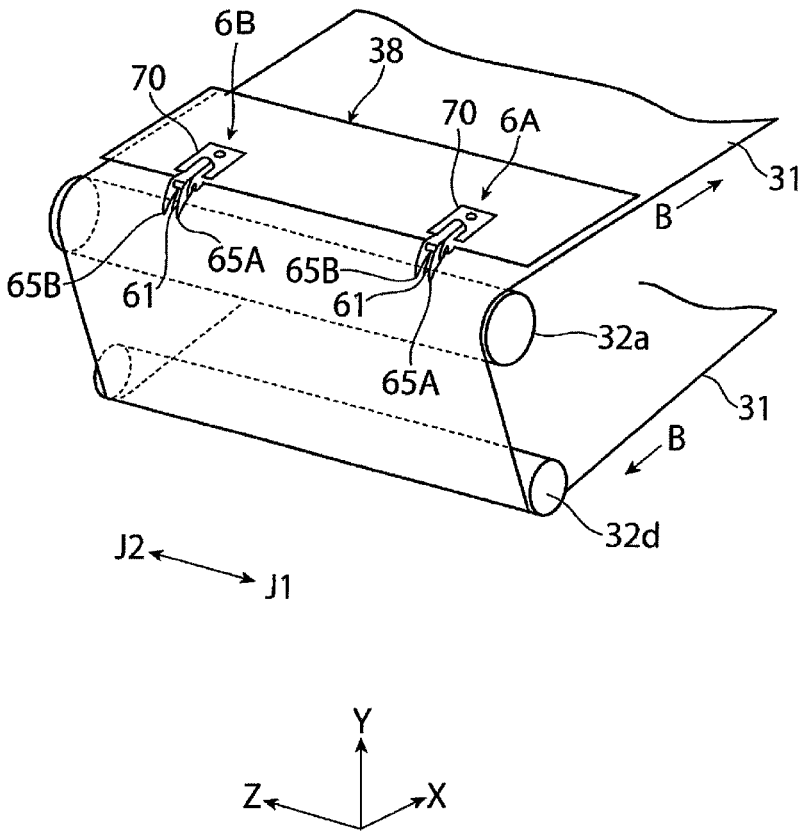
FIG. 3 is a schematic perspective view of another part of the image forming apparatus shown in FIG. 1.

As illustrated in FIGS. 2 and 3 and other figures, a plurality of the peel-off sections 6 are arranged in the width direction J of the intermediate transfer belt 31 with an appropriate interval therebetween. In the first exemplary embodiment, the sheet peel-off section 6 includes a pair of sheet peel-off sections 6A and 6B.

The following descriptions of the sheet peel-off section 6 apply to the pair of sheet peel-off sections 6A and 6B, unless otherwise noted.

As illustrated in FIGS. 2, 4A, 4B, 8 and other figures, in the sheet peel-off section 6, the first peel-off unit 61 is attached to a fixing frame 70, which is a support unit, so as to be swingable in directions indicated by arrows D1 and D2 on a pivot that is a support shaft 63. Likewise, the second peel-off unit 65 is swingable in directions indicated by arrows D3 and D4 on a pivot that is the support shaft 63.

Figure 8:
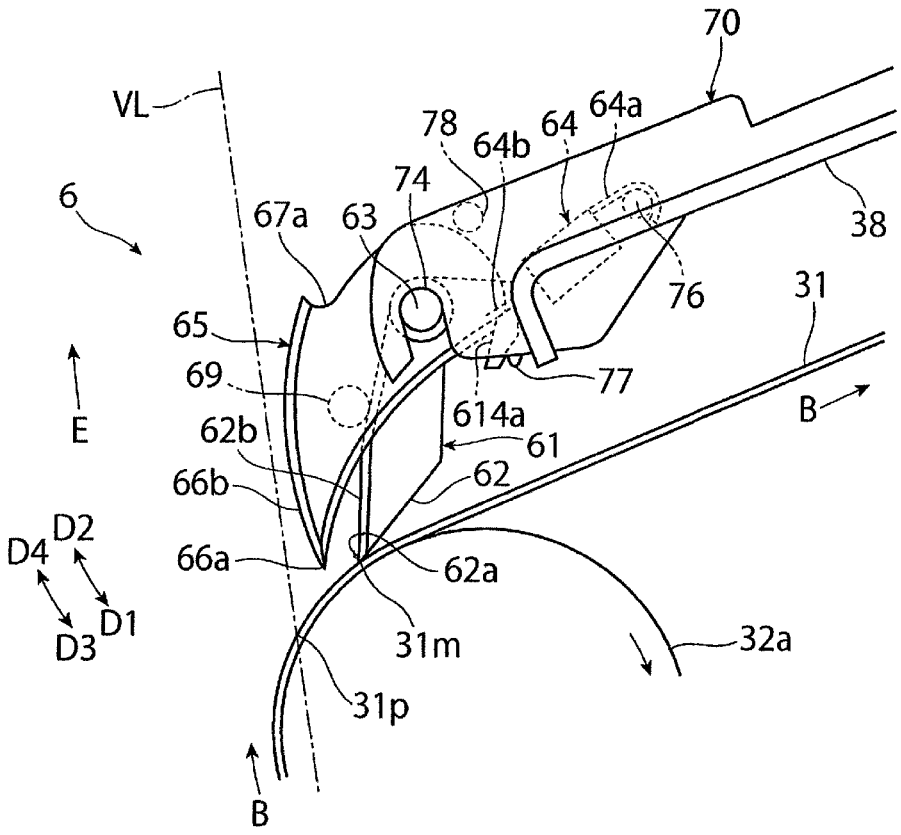
FIG. 8 is a schematic view illustrating the structure of the sheet peel-off section.

As illustrated in FIG. 8 and other figures, the first peel-off unit 61 is urged by an urging unit 64 so that the first peel-off unit 61 is continued to be swung in the direction indicated by the arrow D1. Thus, during use, the end portion 62 of the first peel-off unit 61 is stably in contact with the outer peripheral surface of the intermediate transfer belt 31. For example, a coiled tension spring is used as the urging unit 64.

The second peel-off unit 65 is not urged by an urging unit and is simply swingable around the support shaft 63. In other words, the second peel-off unit is movable independently from the first peel-off unit 61. In still other words, the second peel-off unit is movable to a position such that the end portion 66 is located farther than the end portion 62 of the first peel-off unit 61 from the intermediate transfer belt 31. In any case, the second peel-off unit 65 is movable so that the end portion 66 moves away from the intermediate transfer belt 31.

Figure 6A:
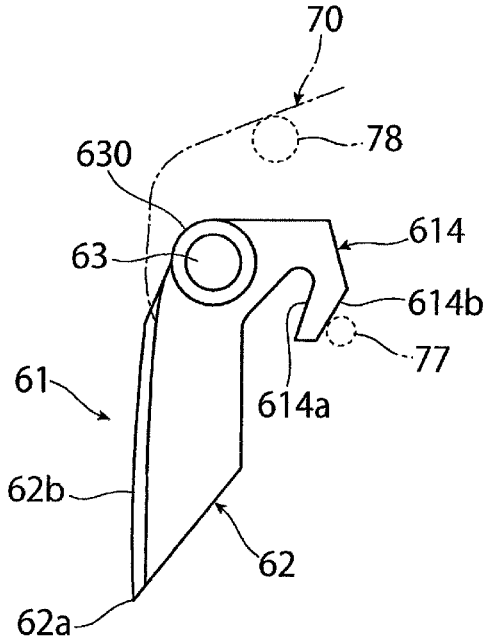
FIG. 6A is a schematic view of a first peel-off unit of the sheet peel-off section.

As illustrated in FIG. 6A and other figures, the first peel-off unit 61 of the sheet peel-off section 6 includes a shaft portion 630 that includes the support shaft 63, the end portion 62 that extends in one direction from the shaft portion 630 and that is tapered, and an arm portion 614 that extends from the shaft portion 630 in a direction at an angle to the direction in which the end portion 62 extends. A facing portion 62*b* of the end portion 62, which faces the sheet 9 that is peeled off, has a blade-like shape whose cross section is tapered toward the sheet 9 in consideration of, for example, reduction of the area of contact between the sheet 9 and the facing portion 62*b*.

As illustrated in FIGS. 6A and 8, the arm portion 614 of the first peel-off unit 61 has a groove-shaped engagement portion 614*a*, which is engageable with an attachment portion 64*b* at one end of the urging unit 64. The engagement portion 614*a* is formed as a recessed portion that is cut diagonally upward from a position below an end portion of the arm portion 614.

The second peel-off unit 65 of the sheet peel-off section 6 includes the end portion 66 that is tapered, and a body 67 that extends to a position behind the end portion 66. The body 67 has an attachment hole 68 that allows the second peel-off unit 65 to be rotatably attached to the support shaft 63 of the first peel-off unit 61.

The end portion 66 includes a first facing portion 66*b* and a second facing portion 66*c*. The first facing portion 66*b* faces the sheet 9, which is naturally peeled off from the intermediate transfer belt 31 and reaches thereto, and guides the sheet 9 so as to assist peeling-off of the sheet 9. The second facing portion 66*c* faces the sheet 9 that is peeled off by the first peel-off unit 61 and guides the sheet 9 so as to allow the sheet 9 to pass, when the second peel-off unit 65 swings by being pushed by the sheet 9.

When the second peel-off unit 65 is not swinging in the direction indicated by the arrow D4, the first facing portion 66*b* is curved so as to be convex from the tip 66*a* of the end portion 66 toward the transport path of the sheet 9 or is curved so as to guide the sheet 9 in a direction away from the first peel-off unit 61, and extends to a position near the attachment hole 68. When the second peel-off unit 65 is not swinging in the direction indicated by the arrow D4, the second facing portion 66*c* extends from the tip 66*a* of the end portion 66 apart from the first facing portion 66*b* in a direction away from the transport path of the sheet 9, is curved so as to be convex toward the transport path, and extends to a position beyond the attachment hole 68.

Each of the first facing portion 66*b* and the second facing portion 66*c* has a blade-like shape whose cross section is tapered toward the sheet 9, as with the facing portion 62*b* of the end portion 62 of the first peel-off unit 61.

Figure 6B:
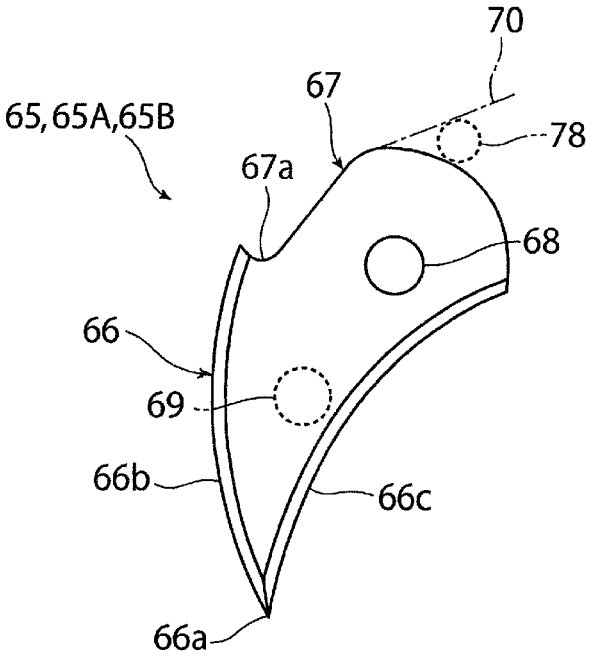
FIG. 6B is a schematic view of a second peel-off unit of the sheet peel-off section.

As illustrated in FIGS. 6B and 8 and other figures, the end portion 66 includes a restraining unit 69 that stops the second peel-off unit 65 at a position such that the distance K from the outer peripheral surface of the intermediate transfer belt 31 to the tip 66*a* of the end portion 66 is maintained and that holds the second peel-off unit 65 at the position.

The restraining unit 69 may be a contact portion that contacts the facing portion 62*b* of the end portion 62 of the first peel-off unit 61 when the end portion 62 is in contact with the intermediate transfer belt 31. In the first exemplary embodiment, which includes the pair of left and right second peel-off units 65A and 65B, the restraining unit 69 is a bar-shaped contact member that connects inner walls of the second peel-off units 65A and 65B that face each other.

As illustrated in FIGS. 6B, 9, and other figures, the body 67 includes a contactable portion 67*a* that contacts a second swing stopper 78 (described below) to stop the second peel-off unit 65 at a maximum swing position when the second peel-off unit 65 swings in the direction indicated by the arrow D4.

As illustrated in FIG. 6B, in the first exemplary embodiment, the contactable portion 67*a* has a curved shape that is recessed from the first facing portion 66*b* of the end portion 66.

As illustrated in FIGS. 4A, 4B, 5A, 5B, 7 to 9, and other figures, the fixing frame 70 of the sheet peel-off section 6 includes facing-surface portions 71 and 72 and an attachment-surface portion 75. The facing-surface portions 71 and 72 face each other with an appropriate interval therebetween to form a gap space 73. The attachment-surface portion 75 is disposed in a rear part on a side to which the facing-surface portions 71 and 72 are fixed and is connected to the facing-surface portions 71 and 72.

Figure 4A:
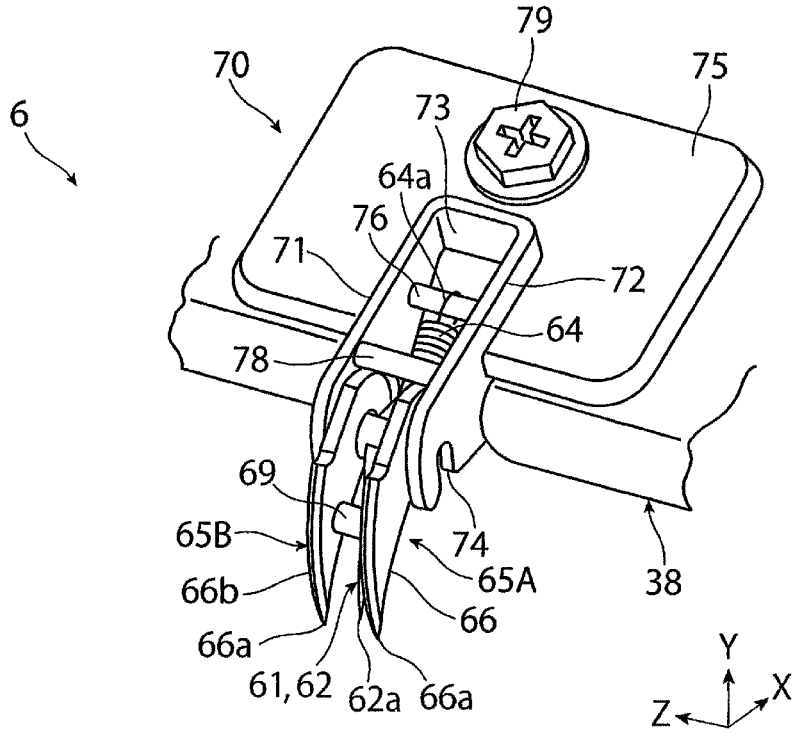
FIG. 4A is a schematic perspective view of a sheet peel-off section of the image forming apparatus when a second peel-off unit is not swinging.
Figure 4B:
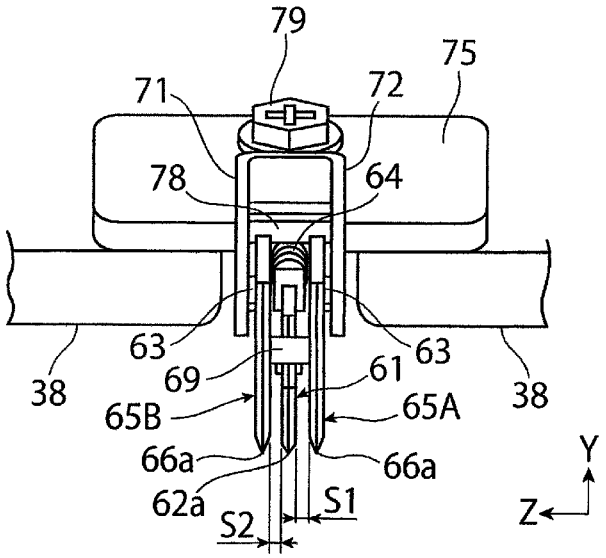
FIG. 4B is a schematic view of the sheet peel-off section shown in FIG. 4A, as seen from a position diagonally in front of the sheet peel-off section.
Figure 5A:
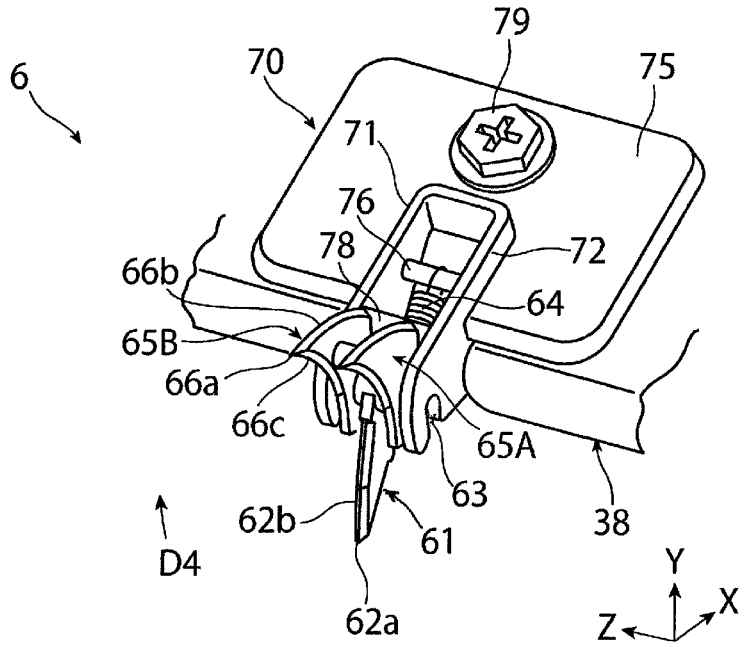
FIG. 5A is a schematic perspective view of the sheet peel-off section of the image forming apparatus when the second peel-off unit has swung.
Figure 5B:
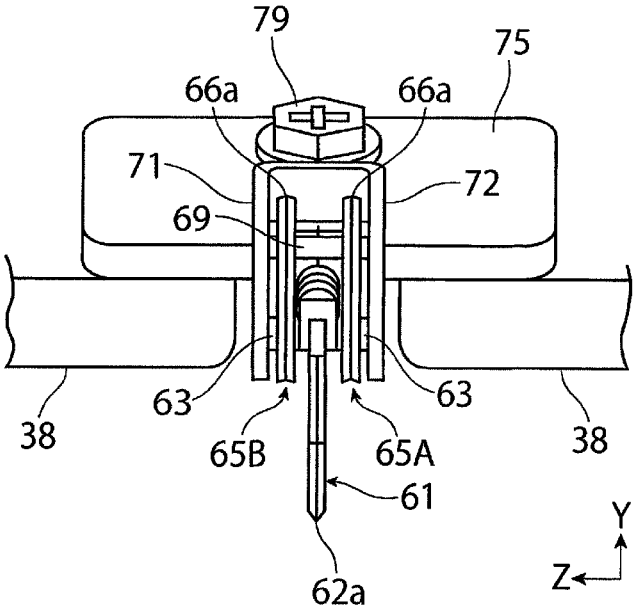
FIG. 5B is a schematic view of the sheet peel-off section shown in FIG. 5A, as seen from a position diagonally in front of the sheet peel-off section.

As illustrated in FIGS. 4A, 4B, 7, and other figures, in end portions of the facing-surface portions 71 and 72 opposite to the attachment-surface portion 75, bearing recesses 74, into which the support shaft 63 of the first peel-off unit 61 is fitted and which rotatably hold the support shaft 63, are formed. The bearing recesses 74 are recesses that are cut upward from positions below the end portions of the facing-surface portions 71 and 72.

A bar-shaped engagement portion 76 is disposed between end portions of the facing-surface portions 71 and 72 opposite to the end portions having the bearing recesses 74. The engagement portion 76 extends across the gap space 73.

As illustrated in FIGS. 6A, 6B, 8, 9, and other figures, a first swing stopper 77 is provided in a part of the facing-surface portions 71 and 72 between the bearing recesses 74 and the engagement portion 76. The first swing stopper 77 restrains swinging of the first peel-off unit 61 in the direction indicated by the arrow D1 and stops the first peel-off unit 61.

The first swing stopper 77 is disposed at a position where an outer end portion 614*b* (back portion) of the arm portion 614 of the first peel-off unit 61 contacts. The first swing stopper 77 prevents the tip 62*a* of the end portion 62 of the first peel-off unit 61 from unnecessarily strongly contacting the outer peripheral surface of the intermediate transfer belt 31.

As illustrated in FIGS. 4A, 4B, 6A, 6B, 8, 9 and other figures, the second swing stopper 78 is provided in a part of the facing-surface portions 71 and 72 between the bearing recesses 74 and the engagement portion 76. The second swing stopper 78 restrains swinging of the second peel-off unit 65 in the direction indicated by the arrow D4 at the maximum swing position and stops the second peel-off unit 65.

The second swing stopper 78 is a member that the restraining unit 69 of the second peel-off unit 65 contacts and stops the second peel-off unit 65 at the maximum swing position when the second peel-off unit 65 swings in the direction indicated by the arrow D4, which is a direction away from the intermediate transfer belt 31. In the first exemplary embodiment, the second swing stopper 78 is a bar-shaped member that connects the facing-surface portions 71 and 72 of the fixing frame 70 to each other.

As illustrated in FIGS. 2, 4A, and 4B, the fixing frame 70 is fixed by attaching the attachment-surface portion 75 to an attachment position on an attachment plate 38, which is disposed downstream of the second-transfer position TP2 of the intermediate transfer section 3. The attachment-surface portion 75 is fixed to the attachment plate 38 by using a fastener 79 such as a fixing screw.

The attachment plate 38 is attached to a support frame (not shown), to which the support rollers 32*a* to 32*e*, the belt cleaning device 36, and the like of the intermediate transfer section 3 are attached.

The sheet peel-off section 6 is assembled, for example, in the following way.

First, the attachment holes 68 of the pair of left and right second peel-off units 65A and 65B are fitted onto the support shaft 63 of the first peel-off unit 61. Thus, the pair of left and right second peel-off units 65A and 65B are attached to the first peel-off unit 61.

Next, as illustrated in FIGS. 4A, 4B, 5A, 5B, 7, and other figures, the support shaft 63 of the first peel-off unit 61, to which the pair of second peel-off units 65A and 65B are attached, is fitted into the bearing recesses 74 of the facing-surface portions 71 and 72 of the fixing frame 70. Then, as illustrated in FIGS. 8, 9, and other figures, the urging unit 64, which is a tension spring, is attached by engaging an attachment portion 64*a* at one end thereof with the bar-shaped engagement portion 76 between the facing-surface portions 71 and 72 of the fixing frame 70, and by engaging the attachment portion 64*b* at the other end thereof with the bar-shaped engagement portion 614*a* of the arm portion 614 of the first peel-off unit 61.

Thus, as illustrated in FIGS. 7 to 9 and other figures, the first peel-off unit 61 is attached to the fixing frame 70 so as to be swingable in directions indicated by the arrows D1 and D2 on a pivot that is the support shaft 63, and so as to be urged by the urging unit 64, which is a tension spring, to continue swinging in the direction indicated by the arrow D1.

At this time, the first peel-off unit 61 is stopped as the outer end portion 614*b* of the arm portion 614 contacts the swing stopper 77 of the facing-surface portions 71 and 72 of the fixing frame 70, and is not swingable in the direction indicated by the arrow D1.

As illustrated in FIGS. 7, 9, and other figures, the second peel-off unit 65 (65A, 65B) is attached so as to be swingable in directions indicated by the arrows D3 and D4 on a pivot that is the support shaft 63 of the first peel-off unit 61, which is attached to the fixing frame 70. The directions D1 and D2 in which the first peel-off unit 61 swings and the directions D3 and D4 in which the second peel-off unit 65 swings are respectively the same as each other, because the pivot is the same support shaft 63.

At this time, although the second peel-off unit 65 is swingable in the direction indicated by the arrow D3 by gravity, because the restraining unit 69 is in contact with the facing portion 62*b* of the end portion 62 of the first peel-off unit 61, swinging of the second peel-off unit 65 in the direction indicated by the arrow D3 is stopped.

As a result, the tip 66*a* of the end portion 66 of the second peel-off unit 65 is located at a certain separation distance from the tip 62*a* of the end portion 62 of the first peel-off unit 61 in the swinging direction of the first peel-off unit 61 indicated by the arrow D2.

The separation distance corresponds to a distance (lift) by which the tip 66*a* of the end portion 66 of the second peel-off unit 65 is separated from the outer peripheral surface of the intermediate transfer belt 31 when the sheet peel-off section 6 is actually used. The separation distance may be set at a desirable value by appropriately changing the position of the restraining unit 69 of the second peel-off unit 65 and the contact position with the end portion 62 of the first peel-off unit 61.

As illustrated in FIG. 4B, the second peel-off units 65A and 65B are disposed in such a way that the end portions 66 thereof are separated from the end portion 62 of the first peel-off unit 61 respectively with intervals S1 and S2 therebetween (in the width direction J of the intermediate transfer belt 31).

In this example, the intervals S1 and S2 are the same. However, the intervals S1 and S2 may differ from each other. The intervals S1 and S2 may be set, for example, by appropriately changing the position of attachment to the support shaft 63 of the first peel-off unit 61 or the shape and the like of the end portion 62 of the first peel-off unit 61 or the end portion 66 of the second peel-off unit 65.

As a result, as illustrated in FIGS. 4A, 4B, and other figures, the first peel-off unit 61 and the pair of left and right second peel-off units 65A and 65B are fixed to the fixing frame 70, and assembly of the sheet peel-off section 6 is finished. As described above, the sheet peel-off section 6 according to the first exemplary embodiment is prepared by assembling the pair of sheet peel-off sections 6A and 6B.

As illustrated in FIG. 3, the pair of sheet peel-off sections 6A and 6B, which constitute the sheet peel-off section 6, become usable when the attachment-surface portions 75 of the fixing frames 70 are attached to two predetermined attachment positions on the attachment plate 38 of the intermediate transfer section 3 by using the fasteners 79.

When the pair of sheet peel-off sections 6A and 6B are attached to the attachment plate 38 of the intermediate transfer section 3, as illustrated in FIGS. 7 and 8, the end portion 62 of the first peel-off unit 61 is in contact with the outer peripheral surface of the intermediate transfer belt 31 at a predetermined position 31*m* on the outer peripheral surface, and the end portion 66 of the second peel-off unit 65 (65A, 65B) is not in contact with (lifted above) the outer peripheral surface of the intermediate transfer belt 31.

In this state, the distance K (lift) between the end portion 66 of the second peel-off unit 65 and the outer peripheral surface of the intermediate transfer belt 31 is automatically determined as the end portion 62 of the first peel-off unit 61 contacts the outer peripheral surface of the intermediate transfer belt 31. That is, the position of the end portion 62 of the first peel-off unit 61 is determined as the end portion 62 contacts the outer peripheral surface of the intermediate transfer belt 31, and swinging of the second peel-off unit 65 is stopped because the restraining unit 69 contacts the facing portion 62*b* of the end portion 62 of the first peel-off unit 61. Therefore, the separation distance between the end portion 62 of the first peel-off unit 61 and the end portion 66 of the second peel-off unit 65 in this state is the separation distance K.

The separation distance K of the end portion 66 of the second peel-off unit 65 is set in the range of, for example, 0.5 to 5.0 mm, and preferably, in the range of 0.5 to 3.0 mm.

At this time, because the first peel-off unit 61 is urged by the urging unit 64 so as to swing in the direction indicated by the arrow D1, the tip 62*a* of the end portion 62 is maintained to be in contact with the intermediate transfer belt 31 with an appropriate pressure.

Moreover, because the second peel-off unit 65 is not urged to swing in the direction indicated by the arrow D3 by, for example, the urging unit 64, the second peel-off unit 65 is maintained in a state in which the second peel-off unit 65 is swingable in the direction indicated by the arrow D4. As illustrated in FIG. 9 and other figures, the second peel-off unit 65 is swingable on a pivot that is the support shaft 63 in the direction indicated by the arrow D4.

However, the second peel-off unit 65 is stopped at the maximum swing position by contacting the second swing stopper 78 of the fixing frame 70 and cannot swing in the direction indicated by the arrow D4.

For example, as illustrated in FIG. 9, the maximum swing position of the second peel-off unit 65 in the direction indicated by the arrow D4 is a position such that the tip 66*a* of the end portion 66 of the second peel-off unit 65 is located closer to the ideal transport path VL of the sheet 9. That is, the maximum swing position is set at a position such that the tip 66*a* of the end portion 66 of the second peel-off unit 65 is located in a region opposite to the guide member 46*b* in the guiding transport path Rt2 with the ideal transport path VL therebetween.

Moreover, as illustrated in FIG. 7, in the sheet peel-off section 6, the tip 66*a* of the end portion 66 of the second peel-off unit 65 is located upstream, in the rotation direction B of the intermediate transfer belt 31, of the tip 62*a* of the end portion 62 of the first peel-off unit 61.

That is, as illustrated in FIG. 7, the tip 66*a* of the end portion 66 of the second peel-off unit 65 is disposed in such a way that a straight line L2 that connects the tip 66*a* and the center C1 of the support roller 32*a* of the intermediate transfer belt 31 is located upstream, in the rotation direction B of the intermediate transfer belt 31, of a straight line L1 that connects the tip 62*a* of the end portion 62 of the first peel-off unit 61 and the rotation center C1 of the support roller 32*a* of the intermediate transfer belt 31.

The amount of displacement of the tip 66*a* of the end portion 66 from the tip 62*a* of the end portion 62 (distance in the rotation direction B) is set, for example, in the range of larger than 0 mm and smaller than or equal to 5 mm, and preferably smaller than or equal to 3 mm.

As illustrated in FIG. 7, the position 31*m*, where the end portion 62 of the first peel-off unit 61 of the sheet peel-off section 6 contacts the outer peripheral surface of the intermediate transfer belt 31, is set in a range from a position where the intermediate transfer belt 31 has passed through the second-transfer position TP2 to the position 31*e* of a terminal point of a part of the intermediate transfer belt 31 that is wound around the support roller 32*a*.

In particular, as illustrated in FIGS. 7 and 8, in the sheet peel-off section 6, the end portion 66 of the second peel-off unit 65 is disposed at a position that is downstream, in the rotation direction B of the intermediate transfer belt 31, of a position 31*p* where the leading end 9*a* of the sheet 9, which is being transported, starts to be naturally peeled off from the intermediate transfer belt 31.

As illustrated in FIGS. 7 and 8, the position 31*p* may be a position where the intermediate transfer belt 31 intersects the ideal transport path VL. Here, the term "starts to be naturally peeled off" represents that the sheet 9 is started to be automatically or autonomously peeled off from an image carrier, such as the intermediate transfer belt 31, without being assisted by a peel-off unit.

Functions of Sheet Peel-Off Section

The sheet peel-off section 6 (the sheet peel-off sections 6A and 6B) functions as follows when the image forming apparatus 1 performs an image forming operation.

Figure 10B:
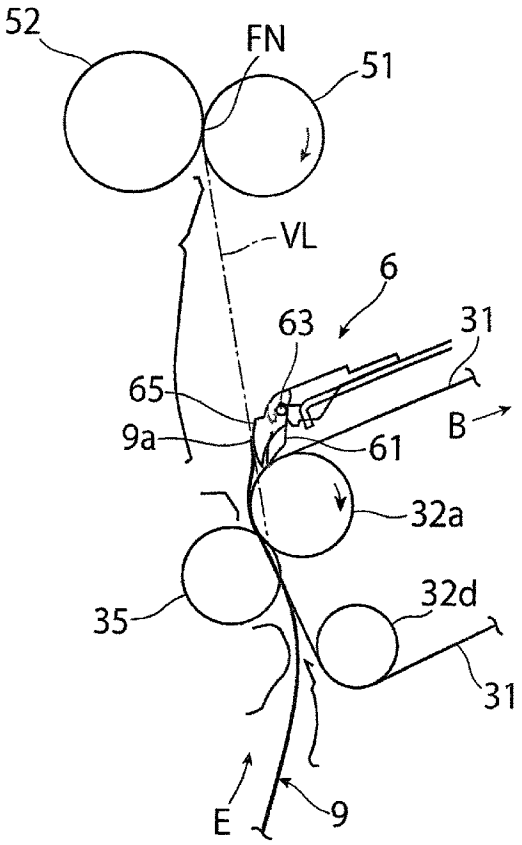
FIG. 10B is a schematic view illustrating an exemplary state in which the leading end of the sheet is peeled off in an auxiliary manner by the second peel-off unit of the sheet peel-off section and moves.
Figure 10A:
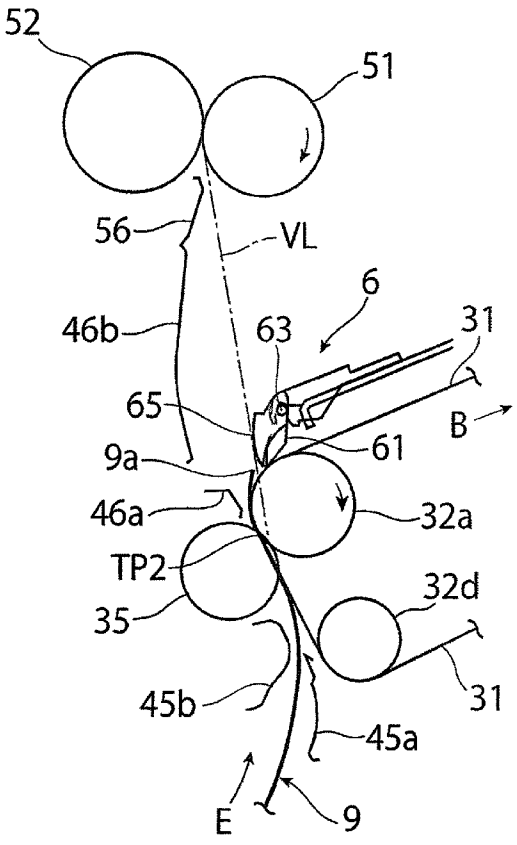
FIG. 10A is a schematic view illustrating an exemplary state in which a leading end of a sheet is started to be naturally peeled off from an intermediate transfer belt and moves to the sheet peel-off section.

For example, excluding a case where the sheet 9U that is not recommended in the user's manual is used, as illustrated in FIG. 10A, the leading end 9*a* of the sheet 9 that has passed the second-transfer position TP2 of the intermediate transfer section 3 is usually started to be naturally peeled off from the intermediate transfer belt 31 at a position upstream, in the rotation direction B of the intermediate transfer belt 31, of the end portion 66 of the second peel-off unit 65 of the sheet peel-off section 6.

In this case, the sheet 9, which has been started to be peeled off from the intermediate transfer belt 31, may pass without receiving a peeling-off action by the sheet peel-off section 6. However, if the sheet 9 contacts the end portion 66 of the second peel-off unit 65 (65A, 65B) of the sheet peel-off section 6, as illustrated in FIGS. 7 and 10B, the sheet 9 moves so as to be in contact with and guided by (the first facing portion 66*b* of) the end portion 66 of the second peel-off unit 65. Thus, peeling off of the sheet 9 is assisted by the end portion 66 of the second peel-off unit 65 (65A, 65B), and the sheet 9 is smoothly transported.

Next, even after the leading end 9*a* has passed the sheet peel-off section 6, the sheet 9 proceeds in the guiding transport path Rt2 while receiving a transport force by being nipped between the intermediate transfer belt 31 that rotates in the direction indicated by the arrow B, and the second-transfer device 35 at the second-transfer position TP2. Then, as partially illustrated in FIG. 11, the leading end 9*a* enters the nip FN in the fixing section 5.

The sheet 9 receives a transport force and is transported by being nipped in the nip FN of the fixing section 5 between the heating rotational body 51, which rotates in the direction indicated by an arrow, and the pressing rotational body 52.

Figure 11:
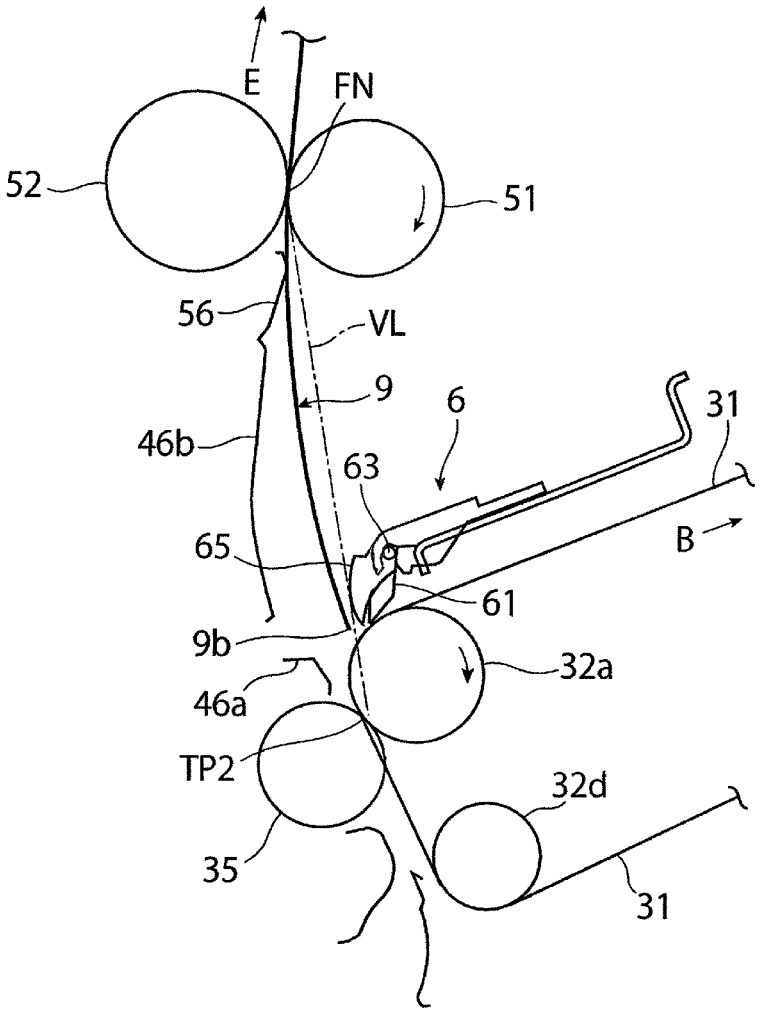
FIG. 11 is a schematic view illustrating an exemplary state in which a trailing end of a sheet contacts an end portion of the second peel-off unit of the sheet peel-off section and moves.

Next, as illustrated in FIG. 11, when the trailing end 9*b* of the sheet 9 has passed through the second-transfer position TP2, if, in particular, the sheet 9 is deformed (curled) in a direction toward a surface thereof on which unfixed toner images have been second-transferred, the curled trailing end 9*b* moves toward the sheet peel-off section 6.

Figure 12:
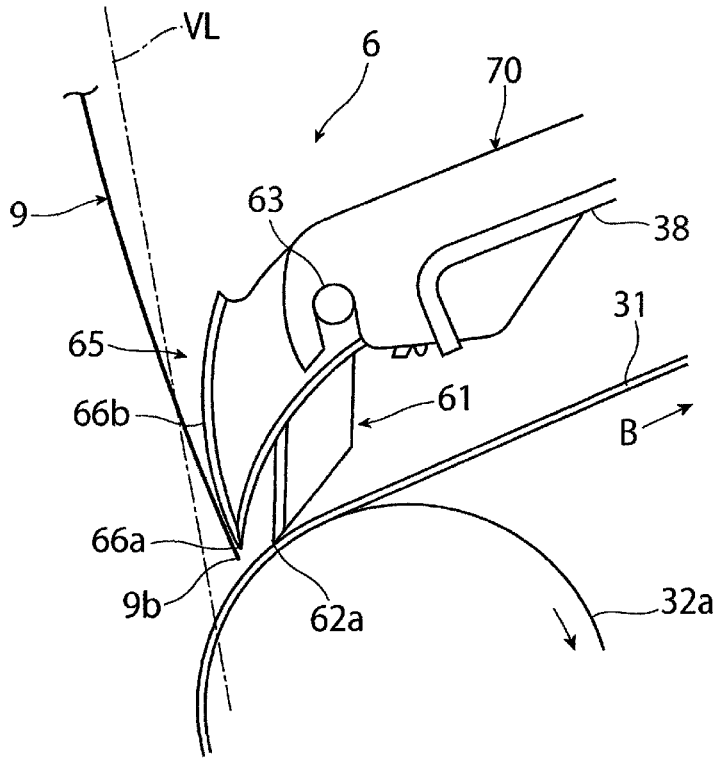
FIG. 12 is a schematic view illustrating an exemplary state in which a trailing end of a sheet does contact an end portion of the first peel-off unit of the sheet peel-off section and moves.

At this time, as illustrated in FIG. 12, the trailing end 9*b* of the sheet 9 may temporarily contact the first facing portion 66*b* of the end portion 66 of the second peel-off unit 65 (65A, 65B) of the sheet peel-off section 6 and move.

However, in this case, as illustrated in FIG. 12, because the end portion 66 of the second peel-off unit 65 (65A, 65B) is not in contact with the outer peripheral surface of the intermediate transfer belt 31, transfer residual toner that remains on the intermediate transfer belt 31 is not scraped off and does not adhere to the end portion 66.

Therefore, even if the trailing end 9*b* of the sheet 9 contacts the end portion 66 of the second peel-off unit 65 (65A, 65B), toner on the end portion 66 does not adhere to the trailing end 9*b* and smear the trailing end 9*b*.

Moreover, in this case, even if the trailing end 9*b* of the sheet 9 contacts the end portion 66 of the second peel-off unit 65 (65A, 65B), the trailing end 9*b* does not contact the end portion 62 of the first peel-off unit 61, which is located downstream of the end portion 66 of the second peel-off unit 65 in the rotation direction B of the intermediate transfer belt 31. Note that, regarding the end portion 62 of the first peel-off unit 61, which is in contact with the outer peripheral surface of the intermediate transfer belt 31, may scrape off transfer residual toner that remains on the intermediate transfer belt 31, and the transfer residual toner may adhere the end portion 62.

The trailing end 9*b* of the sheet 9, which does not contact the end portion 62 of the first peel-off unit 61, is not smeared due to adhesion of toner on the end portion 62 to the trailing end 9*b*.

Accordingly, when the image forming apparatus 1 including the sheet peel-off section 6 performs an image forming operation, smearing of the trailing end 9*b* of the sheet 9 used in the image forming operation, which may occur if toner on the end portion 62 of the first peel-off unit 61 adheres to the trailing end 9*b*, is suppressed.

In this respect, for example, if the end portion 66 of the second peel-off unit 65 (65A, 65B) of the sheet peel-off section 6 is disposed downstream, in the rotation direction B of the intermediate transfer belt 31, of the end portion 62 of the first peel-off unit 61, the following failures occur.

That is, with such disposition, the trailing end 9*b* of the sheet 9 may contact the end portion 62 of the first peel-off unit 61, and toner on the end portion 62 of the first peel-off unit 61 may adhere to the trailing end 9*b* of the sheet 9 and smear the trailing end 9*b*. Accordingly, in this case, it is not possible to prevent toner on the end portion 62 of the first peel-off unit 61 from adhering to the trailing end 9*b* of the sheet 9 and smearing the trailing end 9*b*.

The sheet peel-off section 6 functions as follows for a sheet 9X, which is a sheet that passes without being naturally peeled off from the intermediate transfer belt 31 before reaching the end portion 66 of the second peel-off unit 65 (65A, 65B).

In this case, the leading end 9*a* of the sheet 9X passes the end portion 66 of the second peel-off unit 65 (65A, 65B), which is not in contact with the intermediate transfer belt 31. However, the leading end 9*a* is lifted by the end portion 62 of the first peel-off unit 61, which is in contact with the intermediate transfer belt 31, and is started to be peeled off.

Next, the leading end 9*a* of the sheet 9X, which has been started to be peeled off from the intermediate transfer belt 31 by the first peel-off unit 61, contacts (the second facing portion 66*c* of) the end portion 66 of the second peel-off unit 65, and then moves so as to push the end portion 66 of the second peel-off unit 65.

Figure 13:
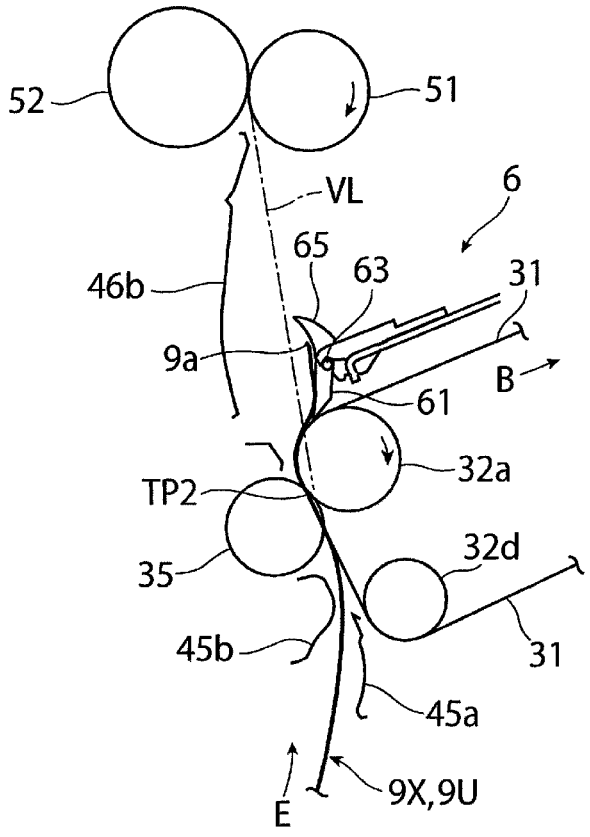
FIG. 13 is a schematic view illustrating an exemplary state in which a sheet is peeled off by the end portion of the first peel-off unit and moves.
Figure 14A:
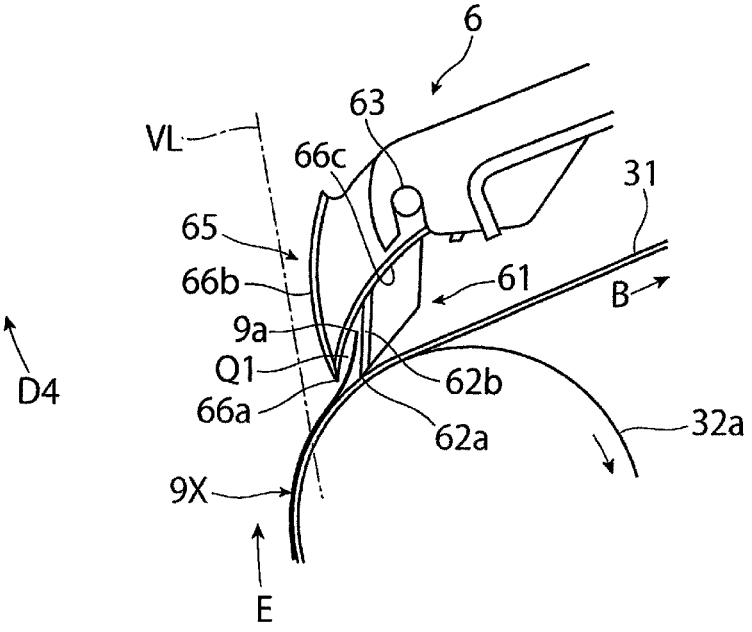
FIG. 14A is a schematic view illustrating an exemplary state in which a sheet is peeled off by the end portion of the first peel-off unit and moves to contact the end portion of the second peel-off unit.
Figure 14B:
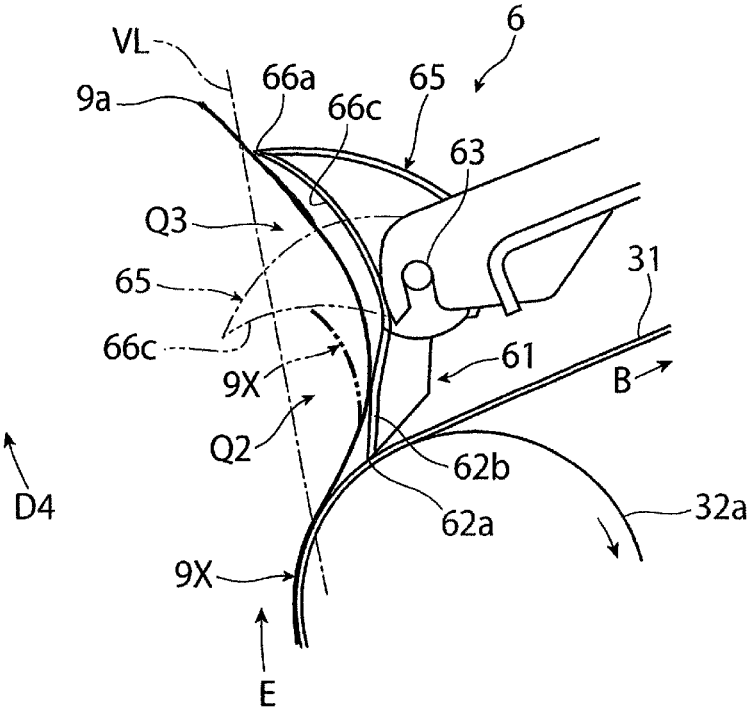
FIG. 14B is a schematic view illustrating an exemplary state in which the second peel-off unit swings by being pushed by the sheet shown in FIG. 14A.

Thus, as illustrated in FIGS. 13, 14A, and 14B, the second peel-off unit 65 is pushed by the sheet 9X that is peeled off by the first peel-off unit 61 and is swung in the direction indicated by the arrow D4 on a pivot that is the support shaft 63. That is, the second peel-off unit 65 becomes displaced so as not to block passage of the sheet 9X that is peeled off by the first peel-off unit 61.

As illustrated in FIG. 14A, the leading end 9*a* of the sheet 9X, which has been started to be peeled off by the first peel-off unit 61, enters a wedge-shaped space Q1 between (the facing portion 62*b* of) the end portion 62 of the first peel-off unit 61 and (the first facing portion 66*b* of) the end portion 66 of the second peel-off unit 65. Then, the leading end 9*a* of the sheet 9X moves so as to contact and push (the second facing portion 66*c* of) the end portion 66 of the second peel-off unit 65.

Thus, as illustrated in FIG. 14B, the second peel-off unit 65 is pushed by the sheet 9X and swings in the direction indicated by the arrow D4 on a pivot that is the support shaft 63. The second peel-off unit 65 swings so as to expand the space Q1.

At this time, the space Q1, which has the smallest size as illustrated in FIG. 14A before the second peel-off unit 65 swings, is expanded in accordance with the degree of swinging of the second peel-off unit 65.

For example, the space Q1 is expanded to a space Q2 having an intermediate size, which is formed between the second peel-off unit 65 that has swung to a position represented by a two-dot chain line in FIG. 14B and the first peel-off unit 61 that remains in a state represented by a solid line. Then, the space Q2 is expanded to a space Q3 having the largest size, which is formed between the second peel-off unit 65 that has swung to a position represented by a solid line in FIG. 14B and the first peel-off unit 61 that remains in the state represented by the solid line.

As illustrated in FIG. 9, the space Q3 is formed when the contactable portion 67*a* of the second peel-off unit 65 contacts the second swing stopper 78 and the second peel-off unit 65 stops at the maximum swing position. The space Q2 having an intermediate size and the space Q3 having the largest size each form a part of a path through which the sheet 9X that is peeled off by the first peel-off unit 61 passes. As illustrated in FIG. 9 and other figures, when the space Q3 is formed, the facing portion 62*b* of the end portion 62 of the first peel-off unit 61 and the first facing portion 66*b* of the end portion 66 of the second peel-off unit 65 form a curve that is gently curved substantially continuously in the same direction without being bent on the way.

Because the second peel-off unit 65 moves as described above, the second peel-off unit 65 does not block the path of the sheet 9X that is peeled off by the first peel-off unit 61, and the sheet 9X is not retained in the space Q1. Thus, the sheet 9X continues moving by receiving a transport force at the second-transfer position TP2 between the rotating intermediate transfer belt 31 and the second-transfer device 35.

When the sheet 9X passes the sheet peel-off section 6, the sheet 9X moves while being in contact with and guided by a part of the second facing portion 66*c* of the second peel-off unit 65 or moves while autonomously adjusting the position thereof due to the rigidity of the sheet 9X. Finally, the sheet 9X is returned to, for example, the ideal transport path VL.

Next, the sheet 9X moves along the guiding transport path Rt2 after passing the sheet peel-off section 6. Then, the leading end 9*a* of the sheet X enters the nip FN in the fixing section 5 and is transported by obtaining a transport force in the nip FN.

When the trailing end 9*b* of the sheet 9X has passed through the second-transfer position TP2, if the sheet 9X is curled in a direction toward a surface thereof on which toner images have been second-transferred, the curled trailing end 9*b* tends to move toward the first peel-off unit 61 of the sheet peel-off section 6.

Figure 15:
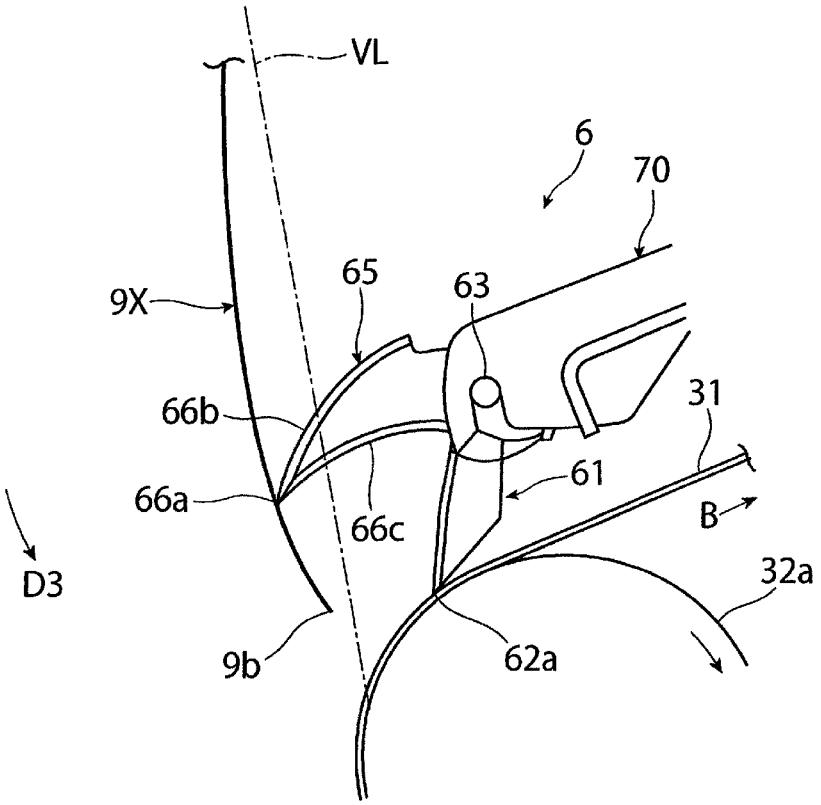
FIG. 15 is a schematic view illustrating an exemplary state in which a trailing end of the sheet shown in FIGS. 14A and 14B does not contact the end portion of the first peel-off unit and moves.

However, in this case, for example, the second peel-off unit 65, which has swung in the direction indicated by the arrow D4 in the sheet peel-off section 6, is no longer pushed by the sheet 9X after the sheet 9X has passed the second-transfer position TP2. Therefore, the second peel-off unit 65 starts swinging in the direction indicated by the arrow D3 so as to return to the original position. As illustrated in FIG. 15, at this time, a part of the sheet 9X near the curled trailing end 9*b* is temporarily pushed by (the end portion 66 of) the second peel-off unit 65, which has started to swing in the direction indicated by the arrow D3 due to gravity, and is moved in a direction away from the first peel-off unit 61.

As a result, the curled trailing end 9*b* of the sheet 9X, which has passed through the second-transfer position TP2, is allowed to pass without contacting the end portion 62 of the first peel-off unit 61.

There may be a case where, until the curled trailing end 9*b* of the sheet 9X finishes passing, the second peel-off unit 65 does not swing in the direction indicated by the arrow D3 due to gravity and continues to be in a position such that the second peel-off unit 65 has swung in the direction indicated by the arrow D4 and to be lifted. In this case, after the curled trailing end 9*b* of the sheet 9X has passed through the second-transfer position TP2, the trailing end 9*b* does not contact the end portion 62 of the first peel-off unit 61.

Accordingly, when the image forming apparatus 1 including the sheet peel-off section 6 performs an image forming operation, even if a sheet 9X is peeled off by the end portion 62 of the first peel-off unit 61 of the sheet peel-off section 6, smearing of the trailing end 9*b* of the sheet 9X, which may occur if toner on the end portion 62 of the first peel-off unit 61 adheres to the trailing end 9*b*, is suppressed.

In this case, the end portion 66 of the second peel-off unit 65, which returns to the original position after swinging in the direction indicated by the arrow D3, temporarily contacts the curled trailing end 9*b* of the sheet 9X. However, because the end portion 66 does not have toner adhering thereto, smearing of the trailing end 9*b* with toner does not occur.

In the sheet peel-off section 6, even if an image forming operation is performed by using a thin sheet 9U that is not recommended in the user's manual, the leading end 9*a* of the thin sheet 9U is lifted by the end portion 62 of the first peel-off unit 61 and peeled off.

In this case, if the thin sheet 9U can swing the second peel-off unit 65 in the direction indicated by the arrow D4 by contacting and pushing the end portion 66 of the second peel-off unit 65, the sheet peel-off section 6 functions in the same as way as in the case where the sheet 9X is used as described above. Thus, the thin sheet 9U safely passes the sheet peel-off section 6 and transported, and smearing of the trailing end 9*b* of the sheet 9U with toner, which may occur if the trailing end 9*b* contacts the end portion 62 of the first peel-off unit 61, is suppressed.

On the other hand, if the thin sheet 9U cannot swing the second peel-off unit 65 in the direction indicated by the arrow D4 even by contacting and pushing the end portion 66 of the second peel-off unit 65, the path of the sheet 9U is blocked by the second peel-off unit 65. Therefore, in this case, because the leading end 9*a* of the thin sheet 9U is stopped in the space Q1 between the first peel-off unit 61 of the sheet peel-off section 6 and the second peel-off unit 65, a part of the sheet 9U behind the leading end 9*a* starts to be deformed so as to be folded and becomes jammed in the sheet peel-off section 6.

However, in this case, occurrence of a failure in that the thin sheet 9U is not peeled off from the intermediate transfer belt 31, transported while adhering to the intermediate transfer belt 31, and is inserted into the belt cleaning device 36 (FIG. 18) is prevented. Thus, it is not necessary to perform an operation of removing the thin sheet 9U from the belt cleaning device 36.

In the sheet peel-off section 6, the end portion 66 of the second peel-off unit 65 is disposed at a position that is downstream, in the rotation direction B of the intermediate transfer belt 31, of the position 31*p* where the leading end 9*a* of the sheet 9 naturally starts to be peeled off from the intermediate transfer belt 31.

Thus, the leading end 9*a* of the sheet 9, which has been started to be peeled off, can easily reach the end portion 66 of the second peel-off unit 65. Also for this reason, the end portion 66 of the second peel-off unit 65 can stably perform peeling off of the sheet 9.

As illustrated in FIG. 4B, in the sheet peel-off section 6, the end portions 66 of the pair of second peel-off units 65A and 65B are disposed in such a way that the end portions 66 thereof are separated from the end portion 62 of the first peel-off unit 61 respectively with the intervals S1 and S2 therebetween (in the width direction J of the intermediate transfer belt 31).

Thus, when the end portion 62 of the first peel-off unit 61, which is in contact with the intermediate transfer belt 31, scrapes off transfer residual toner on the intermediate transfer belt 31, scattering of the toner and adhesion of the toner to the second peel-off unit 65 are suppressed.

As illustrated in FIG. 4B and other figures, in the sheet peel-off section 6, the second peel-off unit 65 includes the pair of second peel-off units 65A and 65B, which are disposed on both sides of the first peel-off unit 61 in the width direction J of the intermediate transfer belt 31.

Thus, the pair of second peel-off units 65A and 65B stably peel off the sheet 9. Moreover, because (the leading end 9*a* of) the sheet 9 that is peeled off by the first peel-off unit 61 contacts and pushes the pair of second peel-off units 65A and 65B, movement (swinging) of the pair of second peel-off units 65A and 65B in the direction indicated by the arrow D4 is stably performed.

Modifications

The present disclosure is not limited to the first and second exemplary embodiments described above and, for example, includes modifications described below.

Figure 16A:
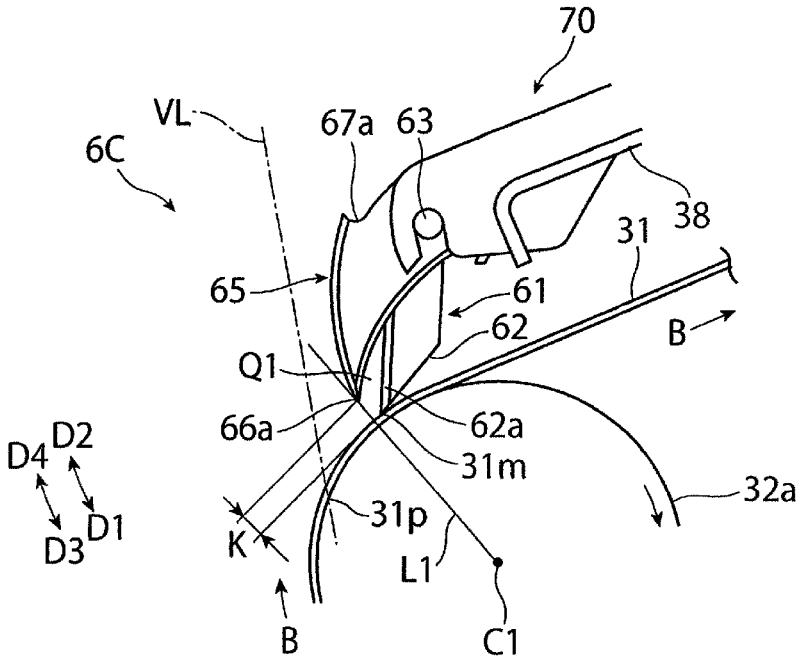
FIG. 16A is a schematic view of a sheet peel-off unit according to a modification.

As illustrated in FIG. 16A, regarding the sheet peel-off section 6, the second peel-off unit 65 may be disposed in such a way that the tip 66*a* of the end portion 66 is located at the same position as the tip 62*a* of the end portion 62 of the first peel-off unit 61 in the rotation direction B of the intermediate transfer belt 31.

In this case, the position where the tip 66*a* of the end portion 66 of the second peel-off unit 65 contacts the intermediate transfer belt 31 is on an extension line of a straight line L1 that connects the rotation center C1 of the support roller 32*a* of the intermediate transfer belt 31 and the position 31*m* where the tip 62*a* of the end portion 62 of the first peel-off unit 61 contacts the intermediate transfer belt 31. To be specific, the contact position of the tip 66*a* of the second peel-off unit 65 is separated from the contact position 31*m* of the tip 62*a* of the first peel-off unit 61 by a distance that corresponds to the distance K between the tip 66*a* of the second peel-off unit 65 and the intermediate transfer belt 31.

Figure 16B:
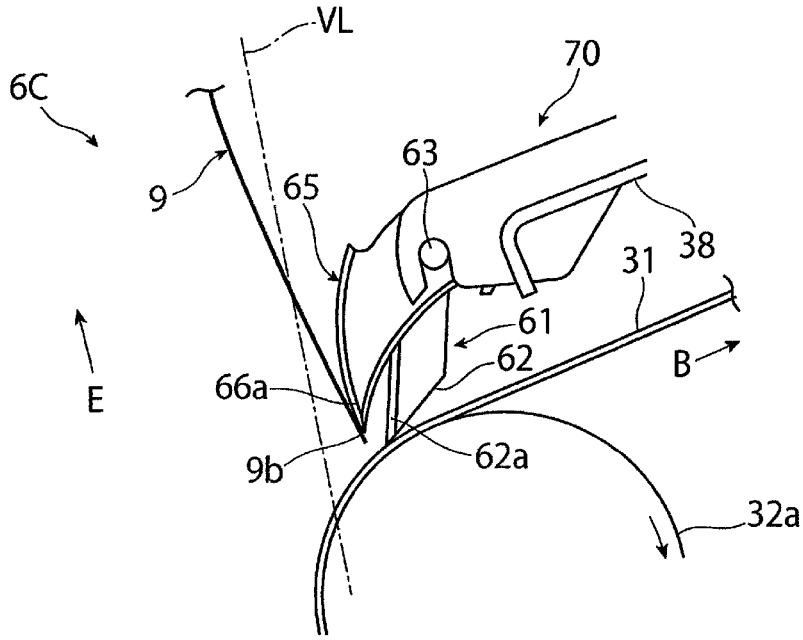
FIG. 16B is a schematic view illustrating the function of the sheet peel-off unit shown in FIG. 16A.

With a sheet peel-off section 6C according to the present modification, which includes the first peel-off unit 61 and the second peel-off unit 65 that are disposed in such a positional relationship, as illustrated in FIG. 16B, when the sheet 9 passes the sheet peel-off section 6C, the trailing end 9*b* of the sheet 9 first contacts the tip 66*a* of the end portion 66 of the second peel-off unit 65, which is not in contact with the intermediate transfer belt 31, and the trailing end 9*b* is not likely to contact the tip 62*a* of the end portion 62 of the first peel-off unit 61, which is in contact with the intermediate transfer belt 31.

Accordingly, also with the sheet peel-off section 6C according to the present modification, smearing of the trailing end 9*b* of the sheet 9 used in the image forming operation, which may occur if toner on the end portion 62 of the first peel-off unit 61 adheres to the trailing end 9*b*, is suppressed. This effect can be obtained in the same way as in a case where the sheet 9X is used.

In a case where a sheet 9 whose trailing end 9*b* is deformed so as to be sharply curved toward a surface thereof on which unfixed toner images have been second-transferred passes the sheet peel-off section 6C according to the present modification, the deformed trailing end 9*b* may circumvent the tip 66*a* of the second peel-off unit 65 and may contact the tip 62*a* of the end portion 62 of the first peel-off unit 61. In this case, the trailing end 9*b* of the sheet 9 is smeared, as toner on the end portion 62 of the first peel-off unit 61 adheres to the trailing end 9*b*.

In the sheet peel-off section 6, the restraining unit 69, which is fixed to the second peel-off unit 65, may be a restraining unit that is capable of changing the position where the restraining unit is stopped by contacting a part of the first peel-off unit 61.

When the restraining unit 69 according to the present modification is used, it is easy to finely adjust or change the distance K between the end portion 66 of the second peel-off unit 65 and the intermediate transfer belt 31.

The sheet peel-off section 6 may include a guide unit that is disposed on the first peel-off unit 61, the second peel-off unit 65, or the fixing frame 70 and that guides the sheet 9 that is peeled off by the second peel-off unit 65 in an auxiliary manner in a direction away from the second peel-off unit 65.

The guide unit may be configured, for example, as a protrusion that includes a guide portion that guides the sheet 9, which has been peeled off, from the second peel-off unit 65 toward the ideal transport path VL. As the guide unit, for example, a guide unit including a plurality of protrusions that are shaped like saw teeth are arranged around the entire outer periphery thereof (such as a star wheel) may be used.

Furthermore, the guide unit desirably has a function of moving a rear part of the sheet 9X, which has been peeled off by the end portion 62 of the first peel-off unit 61, in a direction away from the first peel-off unit 61 when the second peel-off unit 65 moves in the direction indicated by the arrow D4. In consideration of this case, the guide unit may be configured to perform guiding in such a way that at least a part thereof is located in the space Q3 (see FIG. 14B and other figures) that is formed between the second peel-off unit 65 and the first peel-off unit 61 when the second peel-off unit 65 maximally swings in the direction indicated by the arrow D4.

With such a guide unit, because the sheet 9, which has been peeled off by the second peel-off unit 65, is guided by the guide unit in a direction away from the second peel-off unit 65 (and the first peel-off unit 61 in some cases), the sheet 9 moves in a region further away from the end portion 62 of the first peel-off unit 61. As a result, smearing of the trailing end 9*b* of the sheet 9 due to adhesion of toner on the end portion 62 of the first peel-off unit 61 to the trailing end 9*b* is further suppressed.

The sheet peel-off section 6 may include a second urging unit that urges the second peel-off unit 65 toward the intermediate transfer belt 31 in the direction indicated by the arrow D1.

The second urging unit is, for example, a coil spring or the like, as with the urging unit 64 (first urging unit), which urges the first peel-off unit 61 to swing the first peel-off unit 61 in the direction indicated by the arrow D1. The second urging unit may be a coil spring or the like one end of which is attached to the support shaft 63 of the first peel-off unit 61, which rotatably supports the second peel-off unit 65, and the other end of which is connected to the fixing frame 70 side.

In the case where the second urging unit is provided, the urging force of the second urging unit is weaker than the urging force of the first urging unit 64, and the urging force of the second peel-off unit 65 allows the second peel-off unit 65 to swing in the direction indicated by the arrow D4 away from the intermediate transfer belt 31 when the second peel-off unit 65 is pushed by the sheet 9X that is peeled off by the first peel-off unit 61.

With the second urging unit, because the distance K between the end portion 66 of the second peel-off unit 65 is maintained in a stable state while keeping the distance K from the outer peripheral surface of the intermediate transfer belt 31, the second peel-off unit 65 stably peels off the sheet 9. Moreover, because the second peel-off unit 65 swings in the direction indicated by the arrow D4 when pushed by the sheet 9X that is peeled off by the first peel-off unit 61, the second peel-off unit 65 does not cause jamming of the sheet 9X, and smearing of the trailing end 9*b* of the sheet 9X due to adhesion of toner on the end portion 62 of the first peel-off unit 61 to the trailing end 9*b* is also suppressed.

The sheet peel-off section 6 may be a sheet peel-off section 6D that includes one first peel-off unit 61 and one second peel-off unit 65.

If two sheet peel-off sections 6D according to the present modification are disposed with an interval therebetween in the width direction J of the intermediate transfer belt 31, the second peel-off units 65 are desirably disposed at positions that are outside of the first peel-off units 61 in the width direction J of the intermediate transfer belt 31 (rotation-axis direction).

Figure 17A:
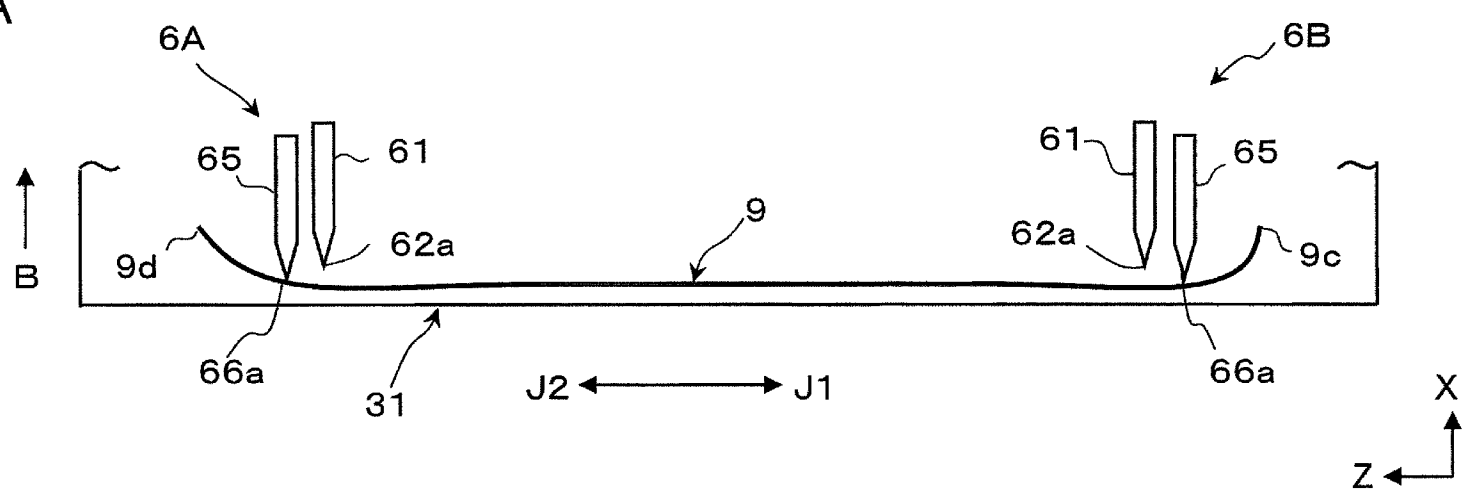
FIGS. 17A and 17B are conceptual views illustrating the disposition of the first peel-off unit and the second peel-off unit in the sheet peel-off section and a state of contact with a sheet whose both end portions are deformed, FIG. 17A illustrating the sheet peel-off section shown in FIG. 3, and FIG. 17B illustrating a sheet peel-off section according to a comparative example.

As illustrated in FIG. 17A, when two sheet peel-off sections 6D according to the present modification are disposed as described above, even if the sheet 9 is transported, after passing the second-transfer position TP2 and naturally peeled off, in such a way that both end portions 9*c* and 9*d* of the sheet 9 are deformed so as to be curved toward a surface of the sheet 9 having the unfixed toner images thereon, the trailing end 9*b* of the sheet 9 first contacts the end portion 66 of the second peel-off unit 65 and is supported by the end portion 66. Therefore, contact of the trailing end 9*b* of the sheet 9 with the tip 62*a* of the end portion 62 of the first peel-off unit 61 is avoided, and smearing of the trailing end 9*b* due to adhesion of toner on the end portion 62 to the trailing end 9*b* is prevented.

Figure 17B:
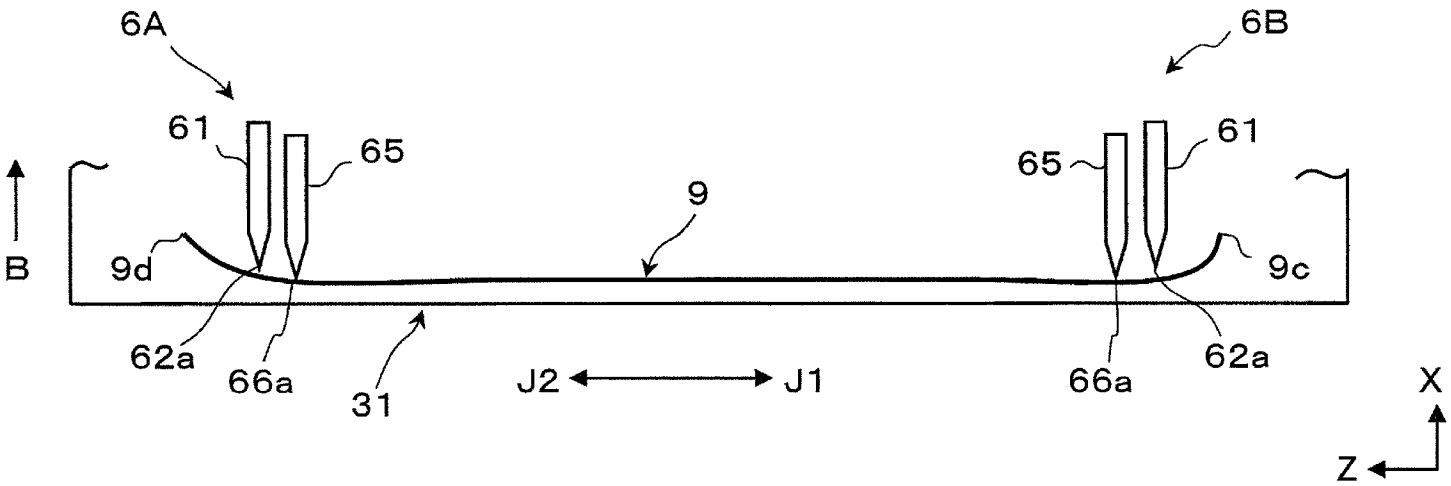

As illustrated in FIG. 17B, for example, if the second peel-off units 65 of the two sheet peel-off sections 6D are disposed at positions inside of the first peel-off units 61 in the rotation-axis direction J of the intermediate transfer belt 31, the following failures occur.

That is, with this disposition, if both end portions 9*c* and 9*d* of the sheet 9 are deformed so as to be curved, the trailing end 9*b* of the sheet 9 may contact the end portion 62 of the first peel-off unit 61 before contacting the end portion 66 of the second peel-off unit 65. Accordingly, in this case, the trailing end 9*b* of the sheet 9 is smeared due to adhesion of toner on the tip 62*a* of the end portion 62 of the first peel-off unit 61 to the trailing end 9*b*.

Three or more sheet peel-off sections 6 (including the sheet peel-off sections 6C and 6D according to the modifications) may be disposed with intervals therebetween in the width direction J of the intermediate transfer belt 31. One sheet peel-off section 6 may be disposed and used provided that doing so is effective.

The sheet peel-off section 6 is not limited to a sheet peel-off section that peels off the sheet 9 from the intermediate transfer belt 31. The sheet peel-off section 6 may be a sheet peel-off section that peels off the sheet 9 from an image carrier, such as a photoconductor drum, an intermediate transfer drum, or the like.

In the first exemplary embodiment, the image forming apparatus 1, which is an example of an image forming apparatus, includes the image forming section 2, which can form a multicolor image composed of developers, and the intermediate transfer section 3. However, the present disclosure can be applied to, for example, an image forming apparatus that includes an image forming section that forms a monochrome image, as long as the image forming apparatus includes the sheet peel-off section 6. An image forming section that forms a monochrome image need not have the intermediate transfer section 3, while the image forming section shares a sheet transport-transfer section.

When applying the present disclosure to an image forming apparatus that forms a monochrome image, the sheet peel-off section 6 is disposed at a position that is downstream of a transfer position where an unfixed image is directly transferred from an image carrier, such as a photoconductor, to the sheet 9.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image carrier that rotates while carrying an unfixed image to be transferred to a recording medium, wherein the image carrier is an image carrier belt that rotates while being supported by a roller, and the image carrier partially contacts the roller;

a first peel-off unit whose end portion is in contact with the image carrier and that peels off the recording medium from the image carrier; and a second peel-off unit whose end portion is not in contact with the image carrier and that peels off the recording medium from the image carrier, wherein the second peel-off unit is disposed in such a way that the end portion thereof is located at a position that is the same as or upstream of a position of the end portion of the first peel-off unit in a rotation direction of the image carrier, and the second peel-off unit is movable so that the end portion thereof moves away from the image carrier, wherein the end portion of the first peel-off unit and the end portion of the second peel-off unit do not overlap with each other in an axial direction of the image carrier.

2. The image forming apparatus according to claim 1, wherein the second peel-off unit is movable independently from the first peel-off unit.

3. The image foil ling apparatus according to claim 1, wherein the second peel-off unit is moved by being pushed by the recording medium that is peeled off by the first peel-off unit.

4. The image forming apparatus according to claim 2, wherein the second peel-off unit is moved by being pushed by the recording medium that is peeled off by the first peel-off unit.

5. The image forming apparatus according to claim 1, wherein, when the second peel-off unit is pushed by the recording medium that is peeled off by the first peel-off unit, the second peel-off unit is moved so as to expand a space between the second peel-off unit and the first peel-off unit.

6. The image forming apparatus according to claim 2, wherein, when the second peel-off unit is pushed by the recording medium that is peeled off by the first peel-off unit, the second peel-off unit is moved so as to expand a space between the second peel-off unit and the first peel-off unit.

7. The image forming apparatus according to claim 1, wherein the second peel-off unit swings on a pivot in a direction such that the end portion thereof moves away from the image carrier, the pivot being a support shaft that is disposed in a part of the second peel-off unit behind the end portion of the second peel-off unit.

8. The image forming apparatus according to claim 2, wherein the second peel-off unit swings on a pivot in a direction such that the end portion thereof moves away from the image carrier, the pivot being a support shaft that is disposed in a part of the second peel-off unit behind the end portion of the second peel-off unit.

9. The image forming apparatus according to claim 3, wherein the second peel-off unit swings on a pivot in a direction such that the end portion thereof moves away from the image carrier, the pivot being a support shaft that is disposed in a part of the second peel-off unit behind the end portion of the second peel-off unit.

10. The image forming apparatus according to claim 4, wherein the second peel-off unit swings on a pivot in a direction such that the end portion thereof moves away from the image carrier, the pivot being a support shaft that is disposed in a part of the second peel-off unit behind the end portion of the second peel-off unit.

11. The image forming apparatus according to claim 5, wherein the second peel-off unit swings on a pivot in a direction such that the end portion thereof moves away from the image carrier, the pivot being a support shaft that is disposed in a part of the second peel-off unit behind the end portion of the second peel-off unit.

12. The image forming apparatus according to claim 6, wherein the second peel-off unit swings on a pivot in a direction such that the end portion thereof moves away from the image carrier, the pivot being a support shaft that is disposed in a part of the second peel-off unit behind the end portion of the second peel-off unit.

13. The image forming apparatus according to claim 7, wherein, when the second peel-off unit swings on the pivot that is the support shaft, the second peel-off unit swings to a position such that the end portion thereof allows passage of the recording medium that is peeled off by the first peel-off unit.

14. The image forming apparatus according to claim 1, wherein the end portion of the second peel-off unit is located at a position that is downstream, in the rotation direction of the image carrier, of a position on the image carrier where a leading end of the recording medium starts to be peeled off from the image carrier.

15. The image forming apparatus according to claim 1, wherein the first peel-off unit and the second peel-off unit are disposed with an interval therebetween in a rotation-axis direction of the image carrier.

16. The image forming apparatus according to claim 1, wherein a number of the second peel-off unit is two, and the two second peel-off units are disposed on both sides of the first peel-off unit in a rotation-axis direction of the image carrier.

17. The image forming apparatus according to claim 14, wherein the end portion of the first peel-off unit is located at a position of a terminal point of a part of the image carrier belt that is wound around the roller or at a position that is upstream, in the rotation direction of the image carrier belt, of the terminal point, wherein the terminal point is an end point of a contact region between the part of the image carrier belt and the roller.

18. The image forming apparatus according to claim 1, further comprising:

a restraining unit that stops the second peel-off unit at a position such that a distance from the image carrier to the end portion of the second peel-off unit is maintained and that holds the second peel-off unit at the position, wherein the restraining unit is capable of changing the position at which the restraining unit stops and holds the second peel-off unit.

19. The image forming apparatus according to claim 1, wherein the first peel-off unit and the second peel-off unit are each swingable on a pivot in directions such that the end portion thereof moves toward and away from the image carrier, the pivot being a support shaft that is common to the first peel-off unit and the second peel-off unit and that is disposed in a rear part of each of the first peel-off unit and the second peel-off unit, wherein the image forming apparatus includes a first urging unit that urges the first peel-off unit in the direction toward the image carrier and a second urging unit that urges the second peel-off unit in the direction toward the image carrier, and wherein an urging force of the second urging unit is weaker than an urging force of the first urging unit, and the urging force of the second urging unit allows the second peel-off unit to swing in the direction away from the image carrier when the second peel-off unit is pushed by the recording medium that is peeled off by the first peel-off unit.

20. The image forming apparatus according to claim 1, further comprising:

a guide unit that guides the recording medium that is peeled off by the second peel-off unit, in a direction in which the recording medium moves away from the second peel-off unit, at a position on a rear side of the first peel-off unit or the second peel-off unit.

* * * * *